US010184221B2

(12) United States Patent
Watson

(10) Patent No.: US 10,184,221 B2
(45) Date of Patent: Jan. 22, 2019

(54) WATER CONTROL SYSTEM AND METHOD FOR WATER MANAGEMENT

(71) Applicant: Norman Paul Watson, Ridgeland, MS (US)

(72) Inventor: Norman Paul Watson, Ridgeland, MS (US)

( * ) Notice: Subject to any disclaimer, the term of this patent is extended or adjusted under 35 U.S.C. 154(b) by 0 days.

(21) Appl. No.: 15/594,253

(22) Filed: May 12, 2017

(65) Prior Publication Data

US 2017/0314221 A1 Nov. 2, 2017

Related U.S. Application Data

(63) Continuation-in-part of application No. 15/018,306, filed on Feb. 8, 2016, now Pat. No. 10,053,829.
(Continued)

(51) Int. Cl.
*E02B 7/40* (2006.01)
*E02B 8/04* (2006.01)
(Continued)

(52) U.S. Cl.
CPC ..... *E02B 7/40* (2013.01); *E02B 7/34* (2013.01); *E02B 8/045* (2013.01); *E02B 13/02* (2013.01); *E03F 5/107* (2013.01)

(58) Field of Classification Search
CPC ..... E02B 13/02; E03F 5/107
(Continued)

(56) References Cited

U.S. PATENT DOCUMENTS 3,974,654 A 8/1976 Mirto, Jr.
4,073,147 A 2/1978 Nomura
(Continued)

FOREIGN PATENT DOCUMENTS

EP 1830005 B1 3/2012
FR 2630472 * 10/1989
(Continued)

OTHER PUBLICATIONS

Cooke, et al., "Infinitely-Variable, Automated Control Structure for Drainage Water Management", Department of Crop Sciences at http://agronomyday.cropsci.illinois.edu/2004/Tour_A/Auto_Control/, printed Aug. 26, 2014, 1 page, 2004 University of Illinois.
(Continued)

*Primary Examiner* — Sean D Andrish
(74) *Attorney, Agent, or Firm* — Berg Hill Greenleaf Ruscitti LLP

(57) ABSTRACT

An automated water control device comprises a rotatable housing that can be incrementally positioned to control flow of water over an upper or weir edge of the housing. The device is installed at a control point in an impoundment area, such as a settling pond. The housing is selectively rotated to raise and lower the height of the weir edge to a target gate height. Automatic control is provided for operation of the device by a controller communicating with an actuator. A system of the invention includes one or more water control devices and the controller. A method of the invention includes controlling flow of water from an impounded water source by use of the automated water control device. Manual or semi-automated embodiments are also disclosed.

42 Claims, 23 Drawing Sheets

Related U.S. Application Data

(60) Provisional application No. 62/113,005, filed on Feb. 6, 2015.

(51) Int. Cl.
*E02B 7/34* (2006.01)
*E03F 5/10* (2006.01)
*E02B 13/02* (2006.01)

(58) Field of Classification Search
USPC ..... 405/87, 99, 100, 101; 4/507, 508, 512; 251/294
See application file for complete search history.

(56) References Cited

U.S. PATENT DOCUMENTS

| | | | |
|---|---|---|---|
| 4,455,106 | A | 6/1984 | Johnson |
| 5,516,230 | A | 5/1996 | Bargeron et al. |
| 6,171,023 | B1 | 1/2001 | Townshend |
| 6,427,718 | B1 | 8/2002 | Stringam et al. |
| 6,467,998 | B1 | 10/2002 | Timms |
| 6,719,491 | B2 | 4/2004 | Kezele et al. |
| 7,083,359 | B2 | 8/2006 | Aughton et al. |
| 7,114,878 | B2 | 10/2006 | Craig et al. |
| 7,726,907 | B2 | 6/2010 | McCreedy et al. |
| 7,785,042 | B2 | 8/2010 | Scandaliato |
| 8,246,272 | B1 | 8/2012 | Heitz |
| 8,333,895 | B2 | 12/2012 | Albers et al. |
| 8,457,799 | B2 | 6/2013 | Cox |
| 8,474,327 | B2 | 7/2013 | Aughton et al. |
| 8,591,147 | B2 | 11/2013 | Quigley et al. |
| 9,772,609 | B2 | 9/2017 | Goodman et al. |
| 2018/0011452 | A1 | 1/2018 | Goodman et al. |
| 2018/0203472 | A1* | 7/2018 | Dolezilek ..... G05D 7/0641 |

FOREIGN PATENT DOCUMENTS

| | | | |
|---|---|---|---|
| WO | 03083223 | A1 | 10/2003 |
| WO | 2012090984 | A1 | 7/2012 |

OTHER PUBLICATIONS

SlipMeter™, http://www.rubiconwater.com.au/catalogue/slipmeter-usa, 3 pages, Rubicon Water 2014.

* cited by examiner

340

342

332

Scroll to Graph

| Unit ID | Date Stamp | Time Stamp | Water Level | Gate Position | Gate Target | Hours to Target | Voltage | Amps | Temp | Rain ("/24 hr) |
|---|---|---|---|---|---|---|---|---|---|---|
| 19802213996 | 3/26/2017 | 18:50:42 | 13.25" | 13.25" | 11.5" | 6.15 | 12.45 | 4.25 | 82 | 0.025" |
| 19802213996 | 3/26/2017 | 18:42:42 | 13.25" | 13.25" | 11.5" | 6.15 | 12.45 | 3.27 | 82 | 0.025" |
| 19802213997 | 3/26/2017 | 18:42:42 | 17.5" | 19.00" | 16.50" | 1.00 | 12.62 | 1.25 | 84 | 0.025" |
| 19802213997 | 3/26/2017 | 18:00:42 | 17.5" | 19.00" | 16.50" | 1.00 | 12.61 | 1.69 | 84 | 0.025" |
| 19802213998 | 3/26/2017 | 18:00:42 | 33.00" | 31.00" | 31.00" | - | 12.15 | 0.005 | 85 | 0.025" |
| 198022136998 | 3/26/2017 | 12:42:00 | 33.00" | 31.00" | 31.00" | - | 12.18 | 0.005 | 85 | 0.025" |

FIG. 31

WATER CONTROL SYSTEM AND METHOD FOR WATER MANAGEMENT

CROSS REFERENCE TO RELATED APPLICATIONS

This application is a continuation in part application of U.S. patent application Ser. No. 15/018,306 filed on Feb. 8, 2016, which claims priority to U.S. Provisional application Ser. No. 62/113,005 said parent application and said provisional application being incorporated by reference in their entireties herein.

FIELD OF THE INVENTION

The invention relates to water management control devices and systems, and more particularly, to an automated water control device for incremental control of water levels in an impoundment area, a water control system incorporating the device, and a method for water management utilizing the automated water control device. The water control device may be automated or manually controlled.

BACKGROUND OF THE INVENTION

Water impoundment areas are integral aspects of land and water management both in modern and ancient times. These areas can be generally characterized as areas of land that hold non-flowing water originating from natural flowing water sources or man-made water sources. Impoundment areas can be areas set aside for controlling water quality, such as settling ponds, in which sediment and impurities are allowed to settle out of a body of water before the water is allowed to be transported downstream. Modern land and water quality management practices still rely on use of impoundment areas including settling ponds and other non-flowing bodies of water. Landscapes are often altered in agricultural and industrial efforts in which natural drainage must be changed to prevent undesirable erosion or damage to the altered landscapes. Alteration may inevitably create excess sediment and may introduce undesirable minerals or other pollutants into a drainage area. Government regulation also plays an important factor in water management, and government water quality standards may require water to be impounded and treated prior to release of water from a regulated activity.

Some basic principles for construction and maintenance of impoundment areas are common to both modern and ancient times. One basic principle is that the water to be impounded is held in a basin until settling of sediments and impurities can occur. If a rain event or other cause of flooding results in overflow of the basin, then another principle is to allow only the top of the water column to be discharged downstream, either by overflowing the bank or spillway of the basin, or by water flow control over a water control device incorporated within the basin. Since the top of the water column almost always contains the purest water, sediment, contaminants, and other non-desirable materials are held in the settling pond while the top of the water column may be released. This simple method of water control has been documented to greatly improve downstream water quality while virtually eliminating on-site soil erosion.

One common form of a water control device or gate is referred to as a "flashboard riser" or "board riser". This type of water control gate may be constructed of a barrier housing, such as a half pipe shaped member cut from culvert pipe material, with a drain pipe connected to an opening formed in the housing. The flashboard riser is typically installed within an earthen dam such that the earthen dam covers the drain pipe. The front face of the housing is immersed in the water. The drain pipe communicates with a downstream drainage device or another body of water. The front face of the housing has aligned slots which receive cut boards placed in the slots. The boards form a wall of a selected height depending on the number and width of the boards chosen. The impoundment of water is achieved in which only the top of the water column is able to be discharged as it overflows or overtops the top board of the riser. Boards can be added or removed one at a time to account for changes in the level of the water in the basin or settling pond, thereby providing a simple means of control for discharge of water from the settling pond. Examples of where these types of flashboard risers are typically installed include agricultural fields surrounded by relatively low levees, wooded areas where water may be held periodically, and construction sites where soil is disturbed and runoff water impoundment is required.

Although traditional flashboard risers have great utility in diverse water containment applications, there are a number of problems associated with these risers. For example, boards must be individually cut for the housing of each riser. In agricultural applications, farmers may have numerous types of flashboard riser with housings that each requires different sized boards in terms of both width and length. It is known to use boards with interlocking edge surfaces, but these still suffer some amount of leakage and therefore, plastic sheeting may be required to better seal the riser from leakage between boards. Plastic sheeting also becomes a problem in that it must be manually installed with the boards, and it is difficult to effectively encapsulate the boards exposed to water in the pond. Wooden boards swell over time as they immersed in water, thereby making it difficult to remove the boards from the slots in the housing. In general, boards cannot be reused, and are difficult to raise or lower once installed. The user must also enter the water to add or remove boards which makes control a manual effort.

Various types of automatic water control gates are available, but these water control gates are relatively expensive to purchase and install. Due to cost constraints, particularly for agricultural applications in which a large number of flashboard risers may be required, it is not economically feasible to install an automatic water control gate at each required location.

Therefore, there is a need to provide a simple yet reliable water control device that can function similar to a traditional flashboard riser, but which avoids manual labor disadvantages associated with cutting and replacing boards. There is also a need to provide a water control device in which incremental control is achieved with respect to the height of the water column allowed to overflow the water control device. There is also a need for the incremental control of the height of the water column released by the water control device to be achieved with minimal or no manual effort to adjust or manipulate each water control device. There is also need to provide a water control device that reduces operator time and effort associated with standard operation and maintenance. There is also a need to eliminate the need for the operator to enter the water to manage the water control device.

SUMMARY OF THE INVENTION

According to one aspect of the invention, it includes an automated or manual water control device for controlling water levels in water containment areas.

According to a first preferred embodiment of the invention, the water control device comprises a falling gate design comprising a housing with a hinged gate that can be incrementally positioned to control flow of water over the upper edge or surface of the gate. The device is installed at the control point in an impoundment area, such as a settling pond. More specifically, the control point is a selected location where water is allowed to flow downstream from the device. The gate is raised and lowered by rotation of the gate about a hinge that extends substantially horizontally along an axis parallel to the hinge. The gate opens to the inside of the housing. The position of the gate is controlled by panel guides that extend substantially perpendicular to a panel portion of the gate. Accordingly, when the gate is closed and an upper edge of the gate is in a raised position, the panel guides protrude away from the housing. When the gate is opened and the upper edge of the gate is lowered, the panel guides along with the gate panel are withdrawn into the housing. The panel guides are received within corresponding panel guide slots formed in a front facing wall of the housing. The panel guides are generally pie shaped elements in which upper peripheral curved surfaces are received in the corresponding panel guide slots. The panel guides are rotated about the axis located generally at the vertices of converging side surfaces of the panel guides. The height of the gate may be selected to account for minimum and maximum water column levels to be encountered in the body of water in which the device is installed.

According to another or second preferred embodiment, the device includes a rotating weir design including a housing defining an enclosure. The housing has an open upper side or end and at least one upper straight side edge that remains parallel with the surface of the water. This upper edge(s) is referred to herein as a "weir edge" or "weir". The housing is rotated to raise or lower the weir edge(s) to control the water column height in the impoundment area. When the housing is rotated to lower the weir edge of the housing, water is allowed to spill over the weir edge into the housing which communicates with a drain enabling the captured water to move downstream. When the housing is rotated to raise the lower edge above the height of the water column, water flow through the device stops until the water column level exceeds the elevation of the weir edges or most lower weir edge if the housing is rotated. Incremental control of the device can be achieved by means of a chain or cable and a corresponding spool, sprocket, or gear reduction cable drive. An actuator such as a drive motor can be used to drive the chain or cable with very fine incremental adjustments to raise or lower the weir edge(s). Alternatively, an electronic inclinometer can be used to measure the angular change of the weir edge(s) which correspond to changes in elevation of the weir edge(s). Signals from the electronic inclinometer are inputs to the controller which in turn generates output signals to the drive motor or other power device to set the desired gate height.

Regarding the rotation of the housing, it is rotatable about a substantially horizontal axis by the actuator so that the lower most weir edge defines a gate height over which water flows when a water level is above the gate height, the water being captured in the enclosure of the housing and subsequently flowing downstream through a housing extension into the drain.

Control of the gate/weir can be achieved both manually and automatically. In either case, one method of control may include use of a cable that is secured to the gate, and is incrementally controlled by a gear or a spool upon which the cable is wound or connected. For example, in the first embodiment, the cable may be secured to one or more points along the upper portion of the gate, and the opposite end of the cable is routed through one or more rollers so that the cable is placed in a position to be selectively released and wound by an element that imparts a mechanical force on the cable. A rotating gear or rotating spool may provide the mechanical means to adjust the length of the cable in order to selectively raise and lower the upper edge of the gate. The mechanism by which the gate is raised and lowered may also be generally referred to herein as the "actuator".

If the device in either embodiment is to be controlled automatically, the actuator may include an electric drive motor having an output shaft connected to linkage of the spool, sprocket, or gear reduction cable drive to which the cable or chain is attached. Power to the motor may be grid power provided by a municipal power source, or power may be provided at the location of the device; for example, a solar panel, inverter, and battery may be located adjacent the device for powering the electric motor.

Under automatic control, a computer controller may be integrated with the power source so that the device can be programmed for automatic and remote operation.

Another feature associated with the first embodiment of the device includes "C" hinges that allow the gate panel to be removed with simple tools. Another feature is wiper seals located adjacent the panel guides to better seal the device from leakage. Yet another feature is the use of bellow type seals located at the hinge point to prevent leakage. The seals can be replaced as necessary.

Other features associated with the first embodiment of the device include an upper platform upon which an operator may stand for observation or repair of the device. The housing of the device may be separated from the downstream pipe by a slotted arrangement between an outflow flange that extends rearward from the housing and side slots formed on a coupler attached to the facing end of the downstream pipe which receives the outflow flange.

In the first embodiment, the actuator is preferably connected to the gate at least at two points along the upper portion of the gate housing such that the panel guides maintain proper alignment with the guide slots to prevent binding of the panel guides in the guide slots. Gate positions can be manually indexed for future reference, or may be automatically indexed as gate reference points in programmable control of the actuator.

Similarly, for the second embodiment of the device, rotating weir positions can be manually indexed for future reference, or may be automatically indexed as rotating weir reference points in the controller of the device.

If the device in either embodiment is to be controlled manually, one example of the actuator may include a hand crank that can be secured to a ratchet gear or wheel, and rotation of the crank clockwise or counterclockwise results in winding of the cable in either direction. The operator may turn the crank by hand to fully or partially open or close the gate or to fully raise or lower the rotating weir. Indexing of gate positions for the first embodiment may be accomplished by sight referenced markers placed on the panel guide and the operator may operate the crank to align the sight referenced markers with an index point or marker on the mechanical linkage of the actuator. Indexing of weir positions for the second embodiment may be accomplished by sight referenced markers placed on the flange of the rotating housing and a reference marker placed on the stationary flange of the drain housing. Another example of manual control may include the hand crank connected to a gear reduction cable drive.

According to yet a further aspect of manual or automatic control for the first embodiment, a "slow fall" feature is provided in which lowering of the gate is controlled by a torsion spring incorporated within the hinge (similar to a garage door spring) and/or an oil dampener incorporated with the gate. Both of these "slow fall" features are components that selectively control the rate at which the gate is allowed to lower after the initial changing of a gate position setting. This "slow fall" feature is designed for purposes of maintaining settling pond characteristics by only allowing slow release of the very top portion of the water column until the gate reaches a new set position or range limit corresponding to the gate position setting. If the gate was allowed to fall or lower too quickly, this may result in excessive turbulence in the body of water as flow of water would accelerate at a rate which may stir and suspend settled sentiment and particulate contaminants.

According to yet further aspects of automatic control for the first embodiment, a controller used in the system can be provided with control options for gate control, such as control switches to open and close the gate, as well as control options to control the rate at which the gate is opened and closed. In the second embodiment, control switches can be used to control the extent to which the housing is rotated as well as the rate or speed which the housing is rotated.

The controller may be set to automatically change the position of the gate or rotating weir to maintain a predetermined rate of water flowing through the water control device or after a predetermined volume of water passes through the device. For example, the controller may be set to automatically raise the upper edge of the gate or weir edge if a water flow meter of the device indicates the water flowing through the device exceeds a predetermined amount. Alternatively, the controller may automatically raise the upper edge of the gate or weir edge after a predetermined volume of water has passed through the device. In another example, the controller can provide an alert when the flow meter of the device records a pre-set volume has passed through the device, or the rate of water flowing through the device, exceeds a pre-set amount. The controller may be programmable so that multiple water control devices may be controlled by a single controller, and each device may be separately programmed. Each of these control features may also be adopted in the second embodiment in which the controlled raising and lower of the weir edge can be set to control a predetermined flow rate or to control a pre-set volume of water passage through the device.

According to yet further aspects of automatic control, limit switches, sensors, and camera imaging may be used in an integrated control system to determine the present state of each of the devices in the system, and to observe changes to each device upon command signals sent to each.

According to yet further aspects of automatic control, the controller may be connected to a data processing system, by either a wired or wireless connection. A web-based control solution may be a preferable option for remote control of the devices. Accordingly, various control devices could be used such as smart phones, tablets, personal computers, and others. Data may be recorded for each field device, such as gate index positions, gate position history, etc. This data can be used to better predict or determine most optimal gate or weir positions considering current environmental factors such as the current water column height and downstream flow restrictions.

Automatic control associated with the system and method of the invention involves use of the computer processor that receives input functions, processes the inputs, and then generates commands or outputs to control the water control device. The inputs may include the water level, a gate or weir position, date, time, amperage drawn from the control motor, voltage drawn from the control motor, temperature, rainfall, weather information specific to the location of the installed unit, water quality, and photographic/video with motion detection. The water level is determined by, for example, an electronic water level sensor such as a float or pressure sensor. The gate or weir position may be established in a number of ways to include a potentiometer, rotary encoder, inclinometer, and others. The date and time may be established from an electronic timer. The voltage and amperage may be determined from traditional voltage and amperage measuring devices. Temperature may be established from an electronic temperature gauge. Rainfall may be determined from an electronic rainfall monitor. Weather information may be obtained from an Internet source. Water quality may be determined from an electronic water quality measuring device which may measure nitrogen, phosphorous, turbidity, pH, suspended nutrients, and others. Photographic and video information may be obtained from a telemetry-ready and motion activated video camera.

The electronic components within the processing function of the system include a microprocessor, an I/O board, a cellular data board, and a motor controller. Power for the system may be provided by a 20 amp solar panel and electrical energy stored in a 12 V battery. Power for operating control of the gate or weir may be generated by a 12 V DC motor. Various switches, breakers, USB ports, quick connects/disconnects and other components of the system enable overall system integration and control.

One example of data that can be collected, organized and presented to an operator could include water level trends. For example, duck hunters may prefer to hunt rising water. The water control device of the invention is able to monitor water levels as they change over time. If the water is rising, this information may be provided on a user interface for the convenience of the user and in the example of duck hunters, once they view this increasing water level trend, this enables the hunters to approach the water impoundment area with some confidence that conditions are becoming optimal for a hunt.

Another example of monitoring water level for the benefit of user could simply be to confirm whether water is actually present in the area, or whether there is a loss of water. In the event of a leak of the impoundment area, if the water level observed is falling relatively quickly and unrelated to the operation of the water control device for gate/weir movement, this could alert a user that the area needs to be checked for an impoundment leak such as the breach of a impoundment wall. Conversely, an obstruction to prevent drainage can be determined if a gate/weir is lowered, but the water level does not lower over an expected time period. Similarly, if a field is flooded when it should not be, this too is important information that can be conveyed to a user in which water level has suddenly risen without a corresponding gate/weir action.

There are a number of more complex control operations that can be achieved with the system and method of the invention. For example, flow calculations can be derived to determine accurate flow information. If a width of the weir or gate is known (such as 24 inches), and the depth of the water that flows over the weir/gate is known by a water level sensor (such as 4 inches), then the amount of time this condition has existed using the processor results in the ability to calculate the water volume released. In this specific example, assuming the water continuously flows, this flow results in a flow calculation of approximately 1000 gallons per minute or 4.5 acre feet per day.

Another more relatively complex control operation that can be achieved with the system and method of the invention includes selected drawdown protocols. One such protocol includes a continuous conservation drawdown. The term "continuous conservation drawdown" means a water release that allows for significant settling of percentages of waterborne contaminants before release. In other words, the rate of drawdown for presently impounded water is sufficiently slow enough such that the contaminants in the water are able to settle a sufficient amount of time. The gate or weir level is positioned slightly lower than the existing water level, and is continuously lowered to follow the lowering water level allowing for sufficient time for the contaminants to settle out of the water such that it is only the top portion of the water column which is able to flow over the gate/weir.

Another drawdown protocol includes a "calculated conservation drawdown". This term means a water release that results in very nearly all of the waterborne contaminants before release. In this circumstance, the water level is monitored in time. Based upon water depth and time, it is possible to calculate the percentage of the vertical water column that has dropped its contaminant load. Once this parameter is known, the settled portion of the water column can then be released more aggressively in which the settlement line can be followed down the water column by the gate/weir position based upon a settlement algorithm. The settlement line can be generally defined as the known water column height in which water below the settlement line still contains unacceptable amounts of contaminants while water above the settlement line contains acceptable amounts of contaminants. This settlement line can be calculated by an algorithm in which only the settled portion of the water column is released. The algorithm includes a consideration of the known contaminants in the water and how long generally the contaminants take to settle out, the amount of time in which contaminated water has been within the containment area, and the height of the water column.

Yet another drawdown protocol that may be facilitated by the system and method of the invention includes a "native grass moist soil drawdown". This drawdown relates to a method of managing water to encourage the emergent growth of specific plant life considered beneficial to waterfall and general wetland health. This management method is to flood disturbed ground and then slowly remove water. The specific drawdown rate optimal for the surrounding plant life can be determined by a trained professional to affect a predictable growth stand of desirable vegetation. One specific example of a native grass moist soil drawdown could include the removal of 1 inch of water in late spring of a flooded area, such as removal of the one-inch every four days until nighttime temperatures reach 82° F. for three nights out of five consecutive nights. At this point, water removal is stopped and the remainder of the water is allowed to evaporate. In order to achieve this drawdown with a prior art flashboard riser, this would require a user to manually walk into the water to remove one or more boards at a time with many repeat visits to the area. However with the water control device of the present invention, this incremental control can be remotely and automatically controlled.

Yet another complex function that may be facilitated with the system and method of the invention includes live stream water quality monitoring. Using the water level sensor, the gate position sensor, the electronic rain gauge, date, time, and water quality sensors, it is possible to capture a water sample only one there is a flood event. The flood event could be determined by water flow over the gate/weir and only when the gate/weir has been given time to clean itself (such as by measuring flow over the gate/weir according to calculations). The captured water sample can then be tested for various contaminants and the measured contaminants then being used to make water management decisions. One example of a determination could be a long period of drought (as indicated by the rain gauge) followed by a flood event caused by overwatering the impoundment area (such as caused by overuse of well water). Over use of well water may result in higher measured levels of iron and nitrogen for a tested water sample. A management decision could be, in response to the higher iron and nitrogen levels, to slow the level of water release until acceptable iron in nitrogen levels are measured. More specifically, the management decision could result in the gate/weir being raised to allow enough settlement time for the contaminants, then followed by a calculated conservation drawdown along with an alert notification to the operator.

Yet another complex function that can be achieved with the system and method of the invention includes integrated water management. A particular impoundment area may share functional duties with other installed devices. For example, a well or other water source may be installed in the same water impoundment area where the device of the invention is installed. The device of the invention can interact with other installed devices and in the example of a well, the controller associated with the device may directly communicate with an automatic valve on the well to shut off the well to control water levels at the drainage point where the water control device is installed. Similarly, using the same well or other water sources installed within the same impoundment area, the controller of the water control device could directly communicate with these other water sources to maintain a desired water level within the impoundment area. In a further specific example, if the desired water level at the gate/weir position is 12 inches and the water level falls to 10 inches, the controller of the device could send an output command to the well to turn on the well to add water to reach the desired 12 inch water level. As one should appreciate, the ability of the controller of the device to control other installed device provides great functionality for irrigation management systems. Various moisture meters, flowmeters, pressure sensors, and field of valves may all participate within an integrated irrigation management system in which the water control device of the invention may specifically interact with the irrigation management system for precise water level control.

If the water level rises above the selected gate height, excess water will pass through the device and be carried downstream. If the actual water level is above the selected gate height, the body of water will drain until the desired water level is reached. The user interface provides both a reading of the current water level and the set point for the water level to be obtained. Another option for this user interface is to provide photographic images or video streams of the device in which a camera can be mounted to the device and selectively activated to provide images to confirm the status of the body water. This type of visual monitoring may be particularly important during extreme weather events such as flooding in which it may be desired to quickly lower the height of the body of water and to ensure that the device does not become clogged with debris. One camera may be positioned to observe the gate or rotating weir to confirm it remains operational. Other cameras may be used to observe specific locations on the impounded body of water to supplement overall visualization of the body of water. The other cameras used could be, for example, RF cameras that provide visual signals by radio frequency; accordingly, the controller may further include an RF receiver to receive the RF signals.

In connection with control of the system and any water control devices within the system, user interfaces are provided for a user to remotely and electronically control the system by options provided on the user interfaces. A software solution may include numerous user interfaces that guide a user in setting up each device within the system and to subsequently monitor and control each device.

One user interface enables a user to adjust the height of the impounded body of water by selecting a gate level that defines the desired height. The "gate level" or "gate height" is defined as the height at which water will overflow the upper edge of the gate or weir edge of the devices if the water height exceeds that height. A water level sensor incorporated on the device provides a current reading as to the actual water level height in the body of water. This reading is an input to the controller. The user then selects a gate height to define the maximum height of the desired water level. Calculations can made by the controller based on prior uploaded data of the impounded body of water to incrementally raise or lower the gate or housing of the devices to achieve specific water levels over selected period of time. For example, various algorithms can be used to trigger outputs to the gate or rotating weir control mechanisms to raise or lower the gates/weirs based on preexisting data such as the known flowrate of water through the device and the known volume of water to be moved. In this regard, a flowmeter can be used to also measure flowrate in which the flowmeter provides an input to the device controller.

Another user interface may include one which confirms the gate target, that is, the particular height selected for the body of water being controlled. This user interface may further include an estimated time as to when the gate position target will be reached. This estimated time can be calculated according to one or more algorithms that take into account existing variables at the time in which the user sets the new target point. The variables may include parameters such as the maximum flow rate of water through the device, the calculated amount of water to be drained as a function of volume or surface area of the impoundment, among others.

Another user interface may include one that provides graphical data regarding the current status of a device and the projected status of the device at a future time. For example, if the water level is currently higher than the current gate or weir level, a graphical display can be provided showing water level of the impoundment over time, and how the water level will gradually lower until the desired water level is reached. Similarly, if there is a rain event and there is a projection regarding the amount of rain to be experienced over an estimated time, a graphical display can be provided that shows the projected increase in water level of the impoundment over time. Based upon the projected increase, the controller may automatically compensate before or during the rain event to ensure that the impoundment is maintained at a desired water level.

Another function provided on the user interfaces is to enable a user to select a future date and time in which a feature event is to occur, such as lowering the water level in a selected impoundment. Accordingly, the user may select a future start date along with a function, such as lowering the water level. This scheduling function provides great flexibility for managing future events.

Another user interface that may be provided is one which provides historical data regarding the water levels of selected devices. Accordingly, detailed reporting can be provided to a user regarding water levels by device or by a plurality of devices in a system. This data can be very useful to predict water levels in future events and to otherwise shift or class level water levels among adjacent impoundments within a water control system.

Another user interface that may be provided is one which displays certain alarm conditions. Alarm conditions may include quickly rising water levels indicating a flood condition, a low battery, ice conditions, or quickly lowering water levels indicating a breach in the impoundment. The alarm conditions may also include scheduled maintenance reminders in which specific components are scheduled for maintenance, and reminders are graphically displayed to a user for each component that may require scheduled maintenance. The alarm conditions may be broadcasted to mobile phones associated with the system, that is, those mobile phones with apps that allow a user to control the system remotely. The alarm condition may be sent to other electronic communications such as emails.

Another user interface that may be provided is one that displays local weather data and how that weather data may affect operation of the water control system. For example, low temperature conditions may indicate ice formation which could prevent water control by blockage of water through the drains of the water control devices. This weather condition could then automatically generate a warning condition.

Another user interface that may be provided is one that enables the user to choose from a menu of conditions or situations which then executes a plurality of associated commands. For example, the conditions/situations may include irrigation conditions during a growing season: early season drawdown, late season drawdown, a flood schedule, etc. By selecting one of these conditions, the selected devices within a system will automatically control water levels within the corresponding impoundments at pre-designated dates. Accordingly, a user does not have to be physically present to execute water control system functions. The user also has the ability to tailor specific schedules for water control by selecting the future dates and times and selected impoundment areas for drawdown or increased water storage.

For all of the automation features of the invention, the functions are programmable meaning that additional features can be programmed as desired.

In another embodiment of the invention, an irrigated agricultural plot incorporates a number of water control devices thereby facilitating a water control system of the invention for integrated water control of many impounded water areas. The impounded water areas may correspond to selected agricultural fields used for growing crops or used strictly for water impoundment, or combinations thereof.

According to one aspect of the invention, it may therefore be considered an integrated water control system incorporating at least one water control device and a controller that maintains basic control of the device as influenced by pre-set operator parameters or settings.

According to yet another aspect of the invention, it may be considered a method for water management utilizing a manually controlled or automated water control device. The method includes an observation of conditions for an impounded body of water, and determining desired and allowable runoff or drainage of the body of water. The method also includes use of a water control device that is controlled to achieve predetermined runoff or drainage requirements. The device is manipulated to incrementally raise or lower a height of the column of water in which the top portion of the water column is allowed to controllably overflow the gate of the device.

Considering the above described features and aspects of the invention and others to follow, and also considering the drawings, detailed description, and appended claims, in one particular aspect of the invention, it may be considered a rotating weir design in the form of a water control device to control flow of water from an impounded water source, said device comprising: (i) a housing including sidewalls forming an enclosure; (ii) a base secured to said housing and forming a lower portion thereof; (iii) a gate rotatably mounted to said housing along a front portion thereof; (iv) a drain communicating with said enclosure for transporting water from said enclosure; (v) said gate having a panel and at least one panel guide secured to said panel, said at least one panel guide being received in a guide slot formed on said front portion of said housing; (vi) an actuator communicating with said gate to selectively and controllably raise and lower said gate; and wherein said gate is rotatable about an axis by said actuator so that an upper surface of said panel controls water flow over said gate and through said housing.

In another particular aspect of the invention, it may also be considered a water control system to control flow of water from an impounded water source, said system comprising: (a) a water control device including a housing, a gate rotatably mounted to said housing along a front portion thereof, a drain communicating with said housing for transporting water from said enclosure, said gate having a panel and at least one panel guide secured to said panel, said panel guide being received in a guide slot formed on said front portion of said housing, an actuator communicating with said gate to selectively and controllably raise and lower said gate, wherein said gate is rotatable by said actuator so that an upper surface of said panel controls water flow over said gate and through said housing; and (b) a controller communicating with said actuator to control operation of said gate, said controller being programmed to execute selected commands to control said gate.

According to yet another particular aspect of the invention, it may also be considered a method of controlling flow of water from an impounded water source, said method comprising: (i) providing a water control device including a housing, a gate rotatably mounted to said housing, a drain communicating with said housing for transporting water from said housing, said gate having a panel and at least one panel guide secured to said panel, said panel guide being received in a guide slot formed on said housing, and an actuator communicating with said gate to selectively and controllably raise and lower said gate; (ii) providing a controller communicating with said water control device to control operation of said gate, said controller including at least one user interface enabling a user to select commands to be executed for operational control of said gate; (iii) generating at least one input to said controller for detecting a status of said gate; and (iv) executing at least one output from said controller to complete a command for operational control of said gate, said output resulting in manipulation of said actuator to selectively and controllably raise and lower said gate.

According to yet another particular aspect of the invention, it may be considered a water control device for control of water from an impounded water source, comprising: a rotatable housing including sidewalls and end walls forming an enclosure to receive water, said rotatable housing having an open upper end defined by at least one weir edge; a housing extension extending away from one of said end walls and an opening formed in said end wall and through said housing extension; a drain connected to said housing extension for transporting water away from said enclosure; an actuator communicating with said rotatable housing to selectively and controllably rotate said housing thereby raising and lowering said at least one weir edge; and wherein said rotatable housing is rotatable about an axis by said actuator so that said at least one weir edge defines a gate height over which water flows when a water level is above said gate height, said water being captured in said enclosure and subsequently flowing through said drain.

According to another aspect of the invention, it may be considered a water control system to control flow of water from an impounded water source, said system comprising: (a) a rotatable housing including sidewalls and end walls forming an enclosure to receive water, said rotatable housing having an open upper end defined by at least one weir edge; a housing extension extending away from one of said end walls and an opening formed in said one end wall and through said housing extension; a drain connected to said housing extension for transporting water away from said enclosure; an actuator communicating with said rotatable housing to selectively and controllably rotate said housing thereby raising and lowering said at least one weir edge; wherein said rotatable housing is rotatable about an axis by said actuator so that said at least one weir edge defines a gate height over which water flows when a water level is above said gate height, said water being captured in said enclosure and subsequently flowing through said drain; and (b) a controller communicating with said actuator to control operation of said rotatable housing, said controller being programmed to execute selected commands to control a height of said at least one weir edge.

According to yet another aspect of the invention, it may be considered a method of controlling flow of water from an impounded water source, said method comprising: providing a water control device including a rotatable housing including sidewalls and end walls forming an enclosure to receive water, said rotatable housing having an open upper end defined by at least one weir edge; a housing extension extending away from one of said end walls and an opening formed in said one end wall and through said housing extension; a drain connected to said housing extension for transporting water away from said enclosure; an actuator communicating with said rotatable housing to rotate said housing thereby raising and lowering said at least one weir edge; wherein said rotatable housing is rotatable about an axis by said actuator so that said at least one weir edge defines a gate height over which water flows when a water level is above said gate height, said water being captured in said enclosure and subsequently flowing through said drain; providing a controller communicating with said rotatable housing to control rotation of said housing and a selected height for said at least one weir surface, said controller including at least one user interface enabling a user to select commands to be executed for operational control of said rotatable housing; generating at least one input to said controller for detecting a status of said rotatable housing; and executing at least one output from said controller to complete a command for operational control of said rotatable housing, said output resulting in manipulation of said actuator to selectively and controllably raise and lower said at least one weir edge.

According to yet another aspect of the invention, it may be considered a method of controlling flow of water from an impounded water source to achieve a selected drawdown protocol, said method comprising: providing a water control device including a rotatable housing forming an enclosure to receive water, said rotatable housing having an open upper end defined by at least one weir edge; a drain connected to said housing extension for transporting water away from said enclosure; an actuator communicating with said rotatable housing to rotate said housing thereby selectively raising and lowering said at least one weir edge; wherein said rotatable housing is rotatable so that said at least one weir edge defines a gate height over which water flows when a water level is above said gate height, said water being captured in said enclosure and subsequently flowing through said drain; providing a controller communicating with said rotatable housing to control rotation of said housing and a selected height for said at least one weir edge, said controller including at least one user interface enabling a user to select commands to be executed for operational control of said rotatable housing; selecting a drawdown protocol comprising computer instructions executable by said controller; generating at least one input to said controller for detecting a status of said rotatable housing; and executing at least one output from said controller to complete a command for operational control of said rotatable housing, said output resulting in manipulation of said actuator to selectively and controllably raise or lower said at least one weir edge commensurate with said drawdown protocol.

Other features and advantages of the invention will become apparent from a review of the drawings, taken in conjunction with the detailed description which follows.

BRIEF DESCRIPTION OF THE DRAWINGS

FIG. 31 is a user interface showing data associated with various water control devices and recorded data associated with each of the water control devices enabling a user to view system performance and to view incremental water management parameters.

DETAILED DESCRIPTION

Figure 1:
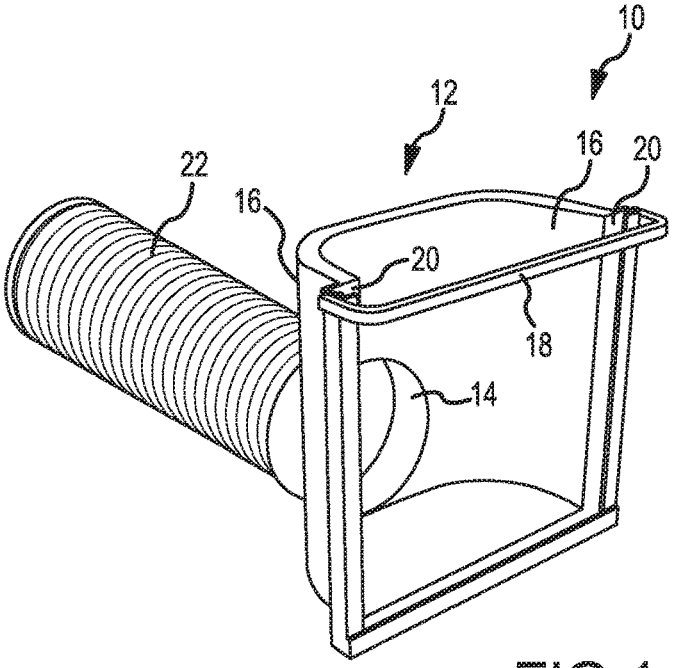
FIG.1 (PRIOR ART)
FIG. 1 is a perspective view of a prior art flashboard riser device.
Figure 2:
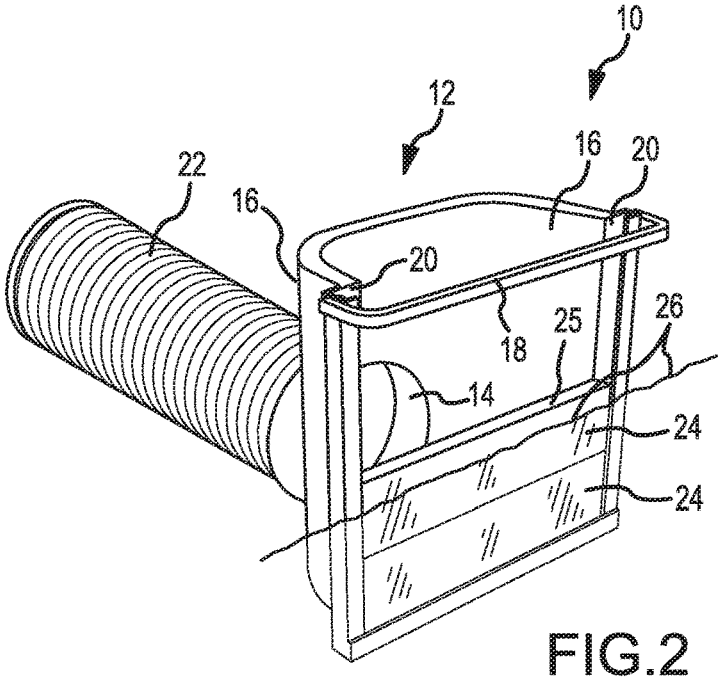
FIG.2 (PRIOR ART)
FIG. 2 is another perspective view of the prior art flashboard riser device of FIG. 1 with one or more boards installed in the device to control water flow.

Referring to FIGS. 1 and 2, one example of a prior art flashboard riser 10 is illustrated. The riser 10 has a housing 12 with a vertically extending sidewall 16. The sidewall 16 forms a partial concave enclosure with an opening 14 formed along a lower central portion of the sidewall 16. The opening 14 communicates with a water conveying tube or pipe 22 that allows water to be carried downstream. The front face of the housing 12 has a pair of opposing board retaining slots 20. The slots are intended to receive one or more boards 24, as shown in FIG. 2. The housing 12 may further include a cross brace or cross support 18 that can be used to manipulate the positioning of the riser 10 during installation or use.

During operation of the riser 10, the boards 24 are placed within the opposing slots 20. The top board 24 has an elevation at its upper surface 25 corresponding to a height of the water column which is intended to be drained if the water column height is above the height or elevation of the upper surface 25. As shown in the example of FIG. 2, the water line 26 is shown as being close to the upper surface 25 of the top board 24.

Figure 3:
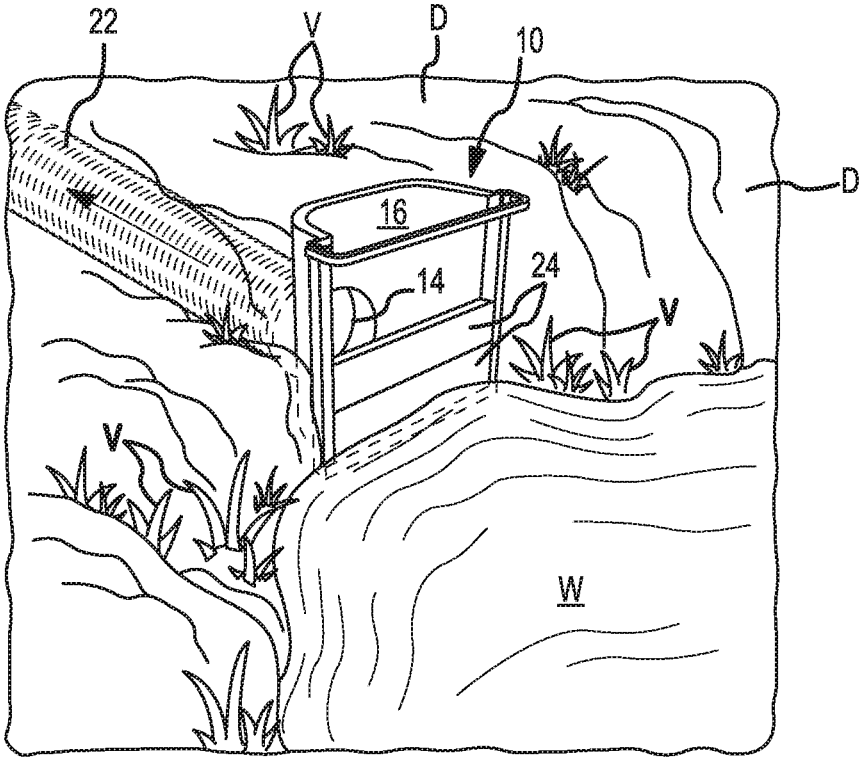
FIG.3 (PRIOR ART)
FIG. 3 is another perspective view of the prior art flashboard riser device of FIG. 1 installed in an impounded body of water.

FIG. 3 illustrates the prior art flashboard riser 10 installed in a containment area in which the riser 10 is used to control downstream flow of water W, such as water in a settling pond. In many typical installations, the settling pond is contained within an earthen dam D. Over time, vegetation V may grow in and around the dam D and therefore, some maintenance may be required to keep the front face of the riser 10 free from obstructions to include vegetation or other objects which may become entangled or caught against the front face of the riser. While flashboard risers similar to that illustrated in FIGS. 1 and 2 have proven to be simple and generally effective water control structures, the water control device of the invention is directed to overcoming some of the problems associated with prior art flashboard risers.

Figure 4:
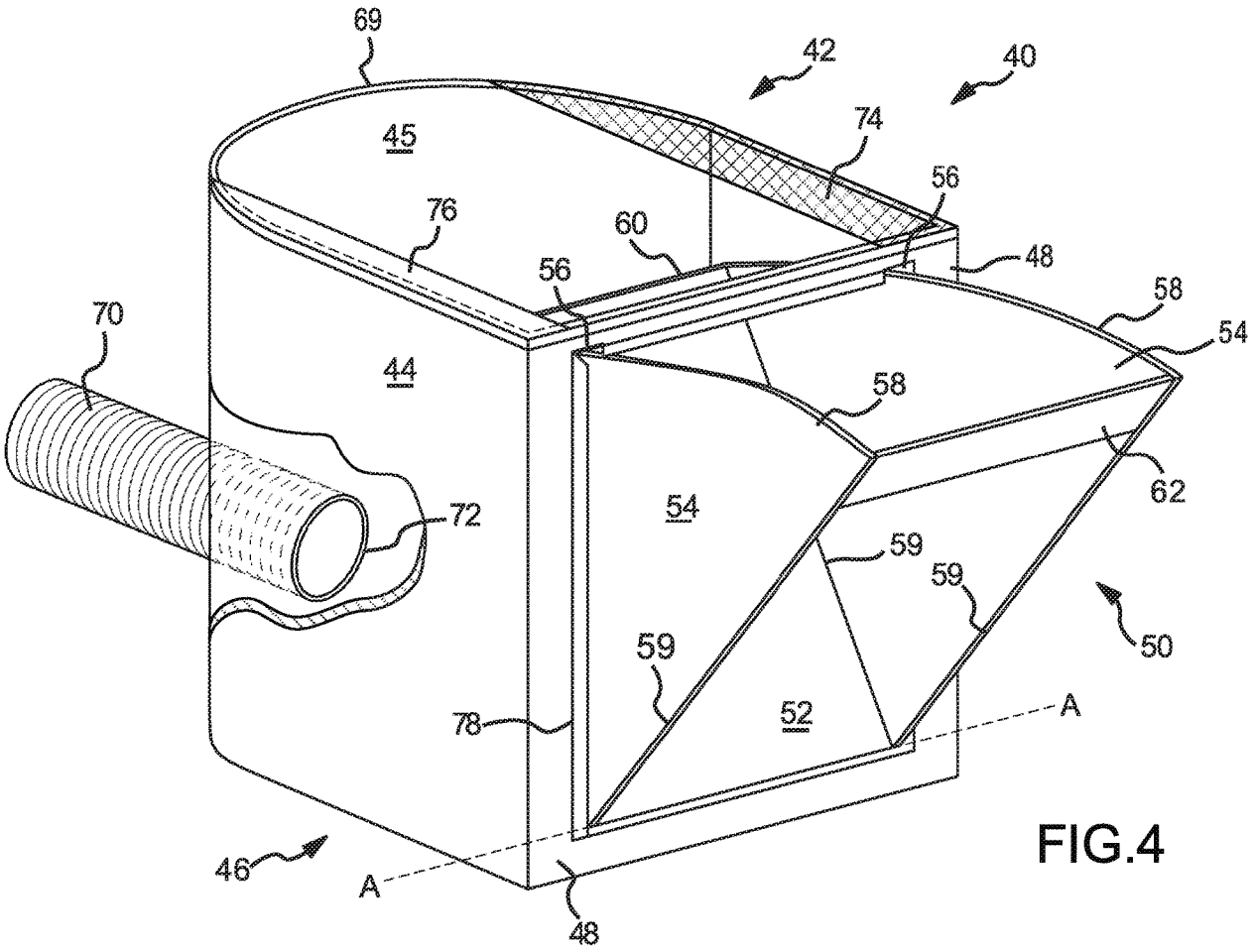
FIG. 4 is a partially fragmentary perspective view of the water control device of the invention in a first embodiment.

Referring to FIG. 4, the water control device of the invention 40 is illustrated in a first preferred embodiment. One primary distinguishing feature of the riser 40 is the use of a rotating gate 50 used to control the height of the water column in the body of water in which the riser is installed. Structurally, the riser 40 includes a housing 42 having two substantially parallel sidewalls 44 interconnected by rear curved sidewall 45. Accordingly, the housing in one respect can be characterized as forming a partial enclosure with an open front face which receives the rotatable gate 50. The lower portion of the housing 42 includes a base or bottom surface 46. The side walls 44 and 45 extend substantially perpendicular from the base 46.

The gate 50 is mounted within the front face of the housing 42, and is rotatable about an axis A-A that extends substantially horizontal according to the orientation of the riser as illustrated. The gate 50 has a panel 52 with an upper edge 60 that functions to control the height of the water column allowed to overflow or overtop the panel 52. Two panel guides 54 are secured to the panel 52. The panel guides function to stabilize the rotation of the gate 50 in desired incremental positions as determined by a user. The front face of the housing 42 includes a supporting frame 48. Two opposing guide slots 56 are formed along the upper portion of the supporting frame 48 and are positioned to receive the upper peripheral curved edges 58 of the panel guides 54. As the gate is rotated, the peripheral curved edges 58 of the panel guides 54 remain within the guide slots 56 ensuring smooth and positive control of the panel 52. The upper peripheral curved edges 58 at their highest elevation reside below the upper edge 69 of the housing 42.

The panel guides 54 are arranged such that the panel 52 is attached to one converging side surface 59 of each of the panel guides 54, and the other or opposite converging side surfaces 59 of the panel guides 54 are oriented so that the panel guides 54 extend substantially perpendicular to the panel 52. Optionally, a cross brace 62 may be used to stabilize the position of the panel guides 54. The cross brace 62 spans between and interconnects upper portions of the panel guides 54 at a point proximate to the exposed converging side surfaces 59.

The housing 42 has an opening 72 which communicates with a tube or pipe 70. This tube/pipe 70 allows the water to be transported downstream as it flows through the housing 42. The opening 72 may be positioned in any desired area of the housing 42. For example, the opening 72 may be positioned in the rear curved sidewall 45, the sidewalls 44, or the base 46.

Other illustrated features of the housing 42 include a platform 74 that partially encloses the upper exposed end of the housing 42. The platform 74 can be provided with a skid free surface so that the user may stand upon the platform in order to conduct maintenance or repair of the riser 40. The opposite side of the housing 42 may include a stiffener 76 which provides upper stiffening support to the housing 42. Wiper seals 78 may be located along the vertical edges of the frame 48 to inhabit leakage of water between the exterior surfaces of the panel guides 54 and the front frame 48 as the panel guides 54 rotate in and out of the housing 42.

Figure 5:
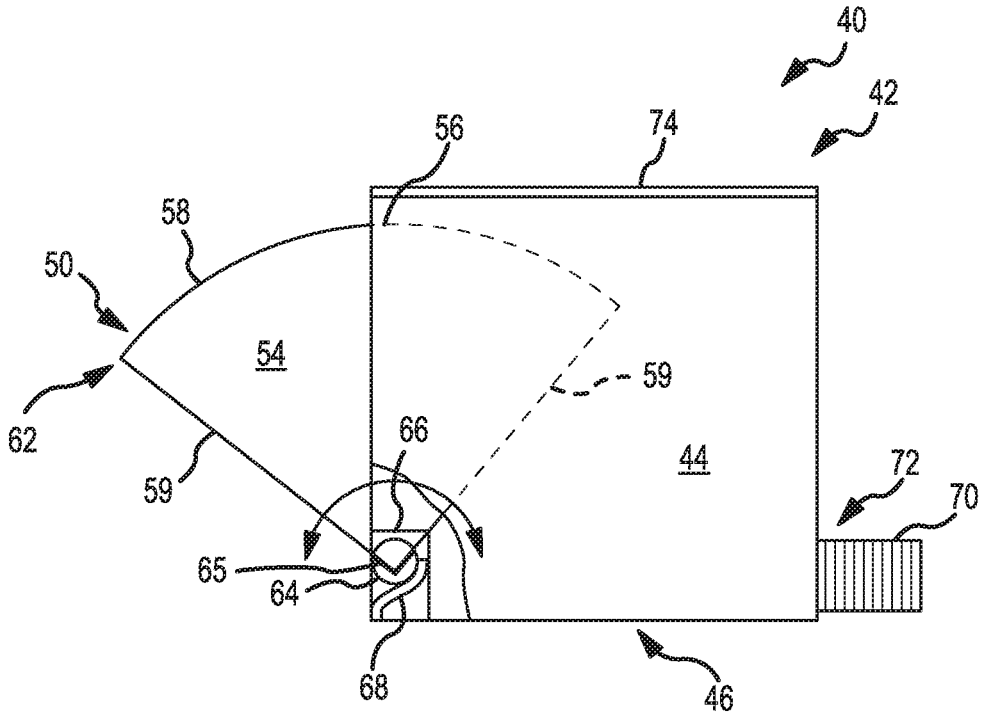
FIG. 5 is a partially fragmentary side elevation view of FIG. 4.

Referring also to FIG. 5, the positioning of the gate 50 is illustrated in its mounted position such that the vertex of the converging side surfaces 59 are mounted to a hinge pin or hinge rod 64 enabling the gate 50 to be selectively rotated. The hinge rod 64 may have a v-shaped channel 65 formed along its length to receive and secure the side surfaces 59 of the panel guides 54. In order to limit or prevent leakage of water through the housing 42 at the location where the hinge rod 64 is mounted, each end of the hinge rod 64 may be sealed with respect to the sidewall 44 of the housing by one or more bellow seals 68 as shown. There are a number of ways in which the hinge rod 64 may be mounted to the housing 42. Depending upon the size of the device 40 as well as the particular height and width of the gate 50, the rotation ability of the hinge rod 64 may be enhanced by use of roller bearings (not shown) mounted to the side walls 44 and arranged to receive the respective opposite ends of the hinge rod 64.

FIG. 5 also illustrates a casing 66 that can be used to house and support components associated with mounting of the hinge rod 64 within or against the sidewall 44. The casing 66, for example, can house the corresponding ends of the hinge rod 64, bearings, races to receive the bearings, and seals. The casing 66 may also house components of an actuator that can be used to manually or automatically change the position of the gate 50. For example, the casing 66 can house gears, cable spools, rollers, dampening mechanisms such as torsion springs or oil dampeners, and motors.

Figure 6:
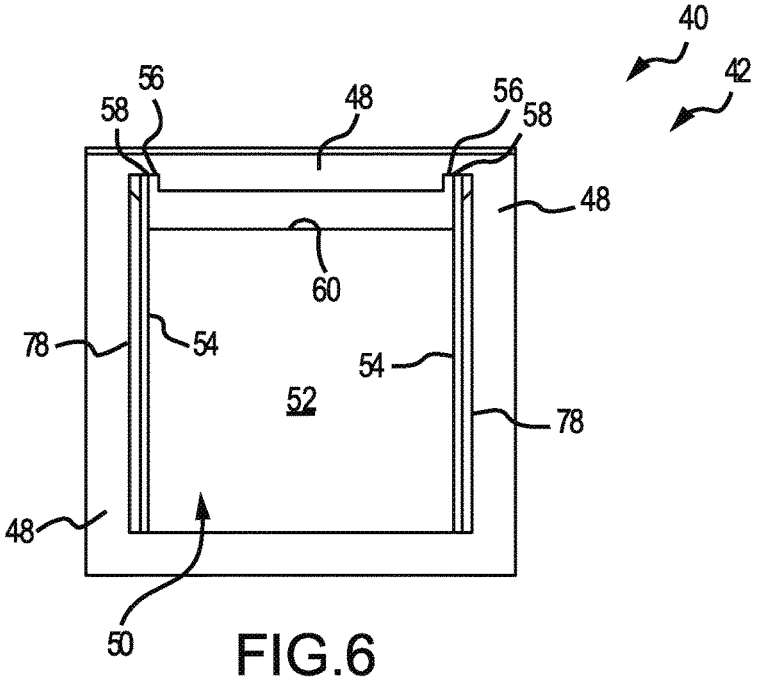
FIG. 6 is a front elevation view of the device of FIG. 4.

Referring to FIG. 6, a front elevation view of the riser 40 is provided and which more particularly illustrates the general relationship of the gate 50 as it is mounted within the frame 48. The cross brace 62 has been removed from the gate for clarity. As shown, the peripheral curved edges 58 of the panel guides 54 are received in the guide slots 56. The upper edge 60 of the panel 52 extends substantially horizontally as shown and is illustrated in a substantially raised position such that the gate 50 is substantially closed.

Figure 7:
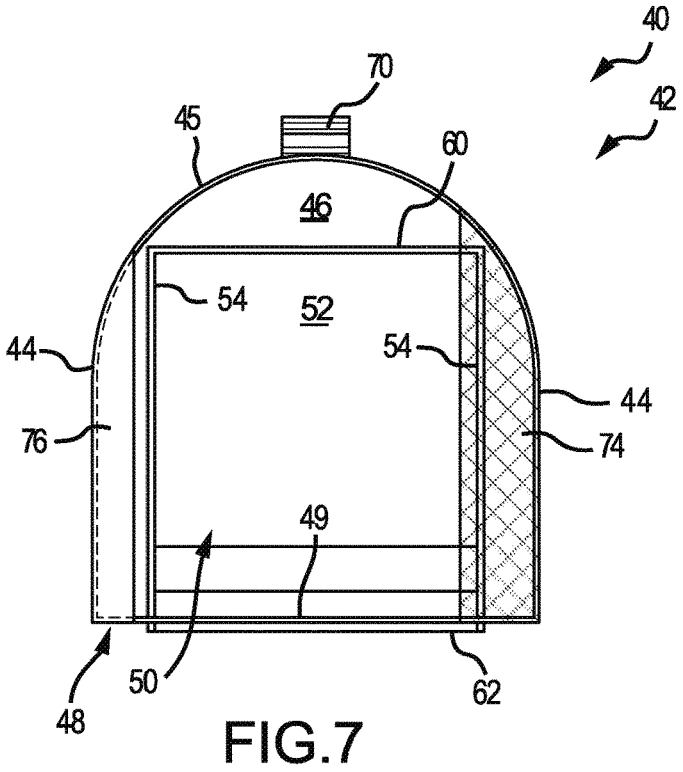
FIG. 7 is a top elevation view of the device of FIG. 4.

Referring to the top elevation view of FIG. 7, further details of the riser 40 are illustrated to include the general size and positioning of the platform 74 and stiffener 76. The platform 74 may be made larger or smaller to best accommodate a stepping and support surface for the user. As also shown, the downstream pipe 70 may be generally centered along the rear curved sidewall 45. FIG. 7 also illustrates the gate 50 in a substantially open position with the panel guides 54 withdrawn into the housing 42.

Figure 8:
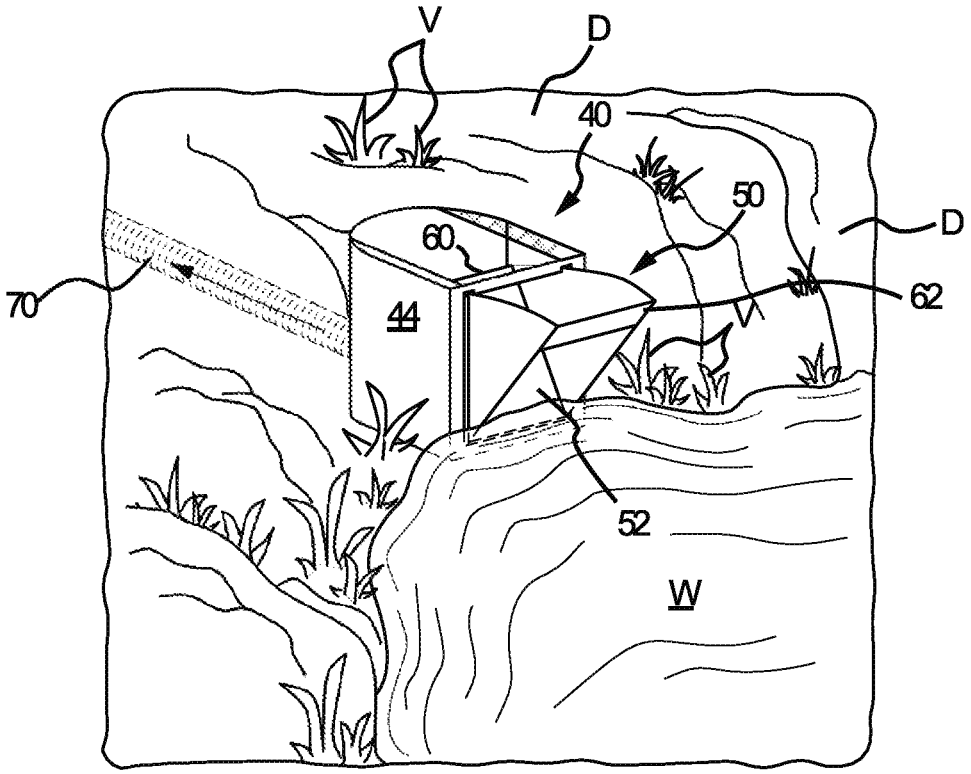
FIG. 8 is a perspective view of the device installed in an impounded body of water.

Referring to FIG. 8, the riser 40 is illustrated in a containment area similar to the containment area shown in FIG. 3. The riser 40 can be used to control downstream flow of water W, such as water in a settling pond. The settling pond is contained within an earthen dam D, and vegetation V may grow in and around the dam D. Preferably, the sidewalls 44 are oriented substantially vertical so that the upper edge 60 of the panel 52 extends substantially horizontal. In this way, water will be able to uniformly flow over the upper edge 60, and will help to prevent uneven forces or torque against the gate 50 which may otherwise prevent it from smoothly rotating in various incremental positions. Although the riser 40 is illustrated within a particular type of water containment installation, it shall be understood that this is but one type of water containment application in which the riser 40 may be installed. In general, the riser 40 may be installed within any body of water in which a surrounding dam or support structure contains the water, and the riser 40 can be installed at a discharge point for water control purposes.

Figure 9:
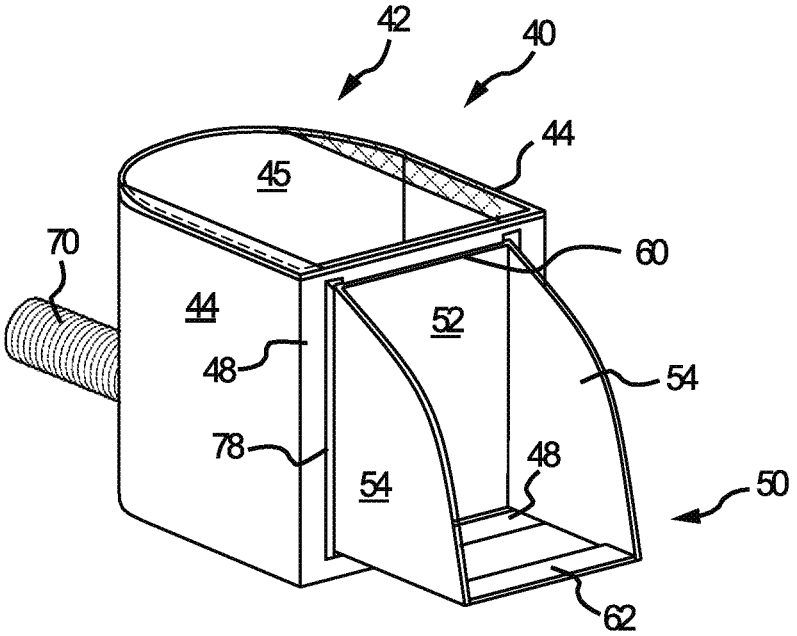
FIG. 9 is a perspective view of the device with the gate of the device in a fully closed position with the upper edge of the gate raised to the highest position.
Figure 10:
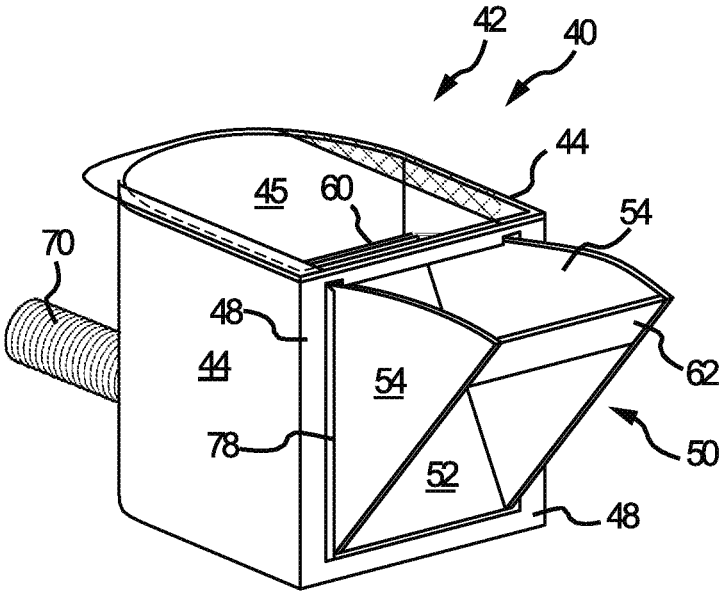
FIG. 10 is a perspective view of the device with the gate of the device in a partially open position with the upper edge of the gate in a partially raised or partially lowered position.
Figure 11:
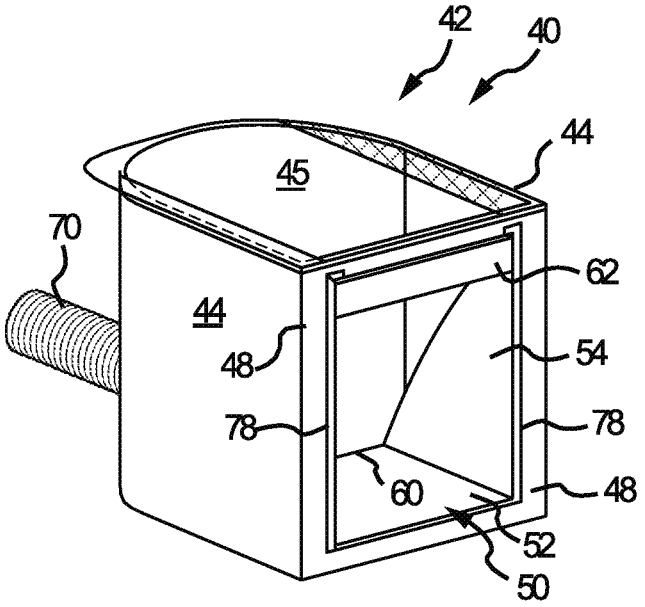
FIG. 11 is a perspective view of the device with the gate of the device in a fully open position with the upper edge of the gate lowered to the lowest position.
Figure 12:
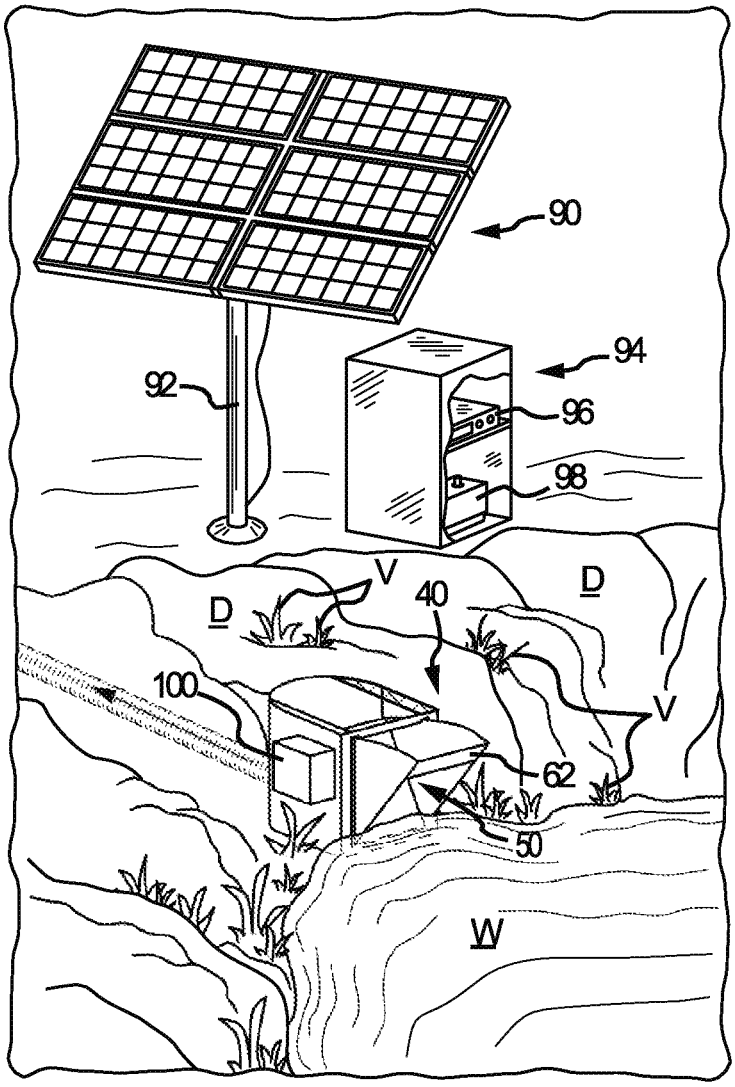
FIG. 12 is a perspective view of the device of the invention installed as shown in FIG. 8, and further illustrating system components including solar panels for a power source, a controller for automatic control of the device, an inverter, a battery, and a control motor.

FIGS. 9-11 illustrates various positions that the gate 50 may be positioned in order to serve as a water control structure. FIG. 9 illustrates a fully raised gate position in which the gate is rotated so that the panel 52 extends substantially perpendicular. Accordingly, the upper edge 60 in this position is at its highest elevation. This position requires the gate 50 to be fully rotated so that the panel guides 54 fully protrude from the front frame 48 of the housing 42. FIG. 10 illustrates a partially raised or partially lowered position in which the gate 50 has been rotated counterclockwise according to the view in this figure. Accordingly, the height of the upper edge 60 is lowered compared to the position illustrated in FIG. 9. FIG. 11 illustrates a fully lowered gate position in which the gate 50 is rotated further counterclockwise so that the panel 52 extends substantially horizontal. Accordingly, the panel guides 54 and panel 52 are received and withdrawn into the housing 42, and the upper edge 60 is at its lowest elevation. The depth of the space within the housing 42 is such that it may receive the panel 52 and panel guides 54 in this lowered gate position. One can appreciate from review of FIGS. 9-11 that the gate 50 may be raised or lowered in an infinite number of positions to accommodate a desired water column level In another embodiment of the invention, FIG. 12 illustrates an automated water control system that can be used for remote and automatic control of the riser 40. Reference numeral 100 generally represents a motor that is mounted to the housing of the riser 40. The motor may be used to rotate or change the position of the gate 50. The motor may be controlled automatically by a controller operated by the user. Accordingly, FIG. 12 also illustrates a control center 94 which may house a controller 96, such as a micro-industrial controller. The controller 96 may communicate by wire or wirelessly with the motor 100. The controller 96 may be programmed to operate the gate 50 and therefore manipulate positioning of the gate 50 in the desired orientation with respect to height of the water column in the impoundment area. FIG. 12 also illustrates one example of how the motor 100 may be independently powered, such as by solar panels 90 mounted locally to the riser 40. Pole mounted panels 90 can be used in which the solar panels 90 can be selectively oriented at a desired orientation with respect to the sun by manipulating the mounting structure, such as the pole 92. The control center 94 may also house a battery 98 used to store electrical energy generated by the solar panels 90. Other equipment may be housed within the control center such as an inverter (not shown) for the solar panels. Alternatively, the motor 100 may have its own integral battery power source, or the motor 100 may be powered by conventional grid power.

Although the riser 40 may be automatically controlled, another aspect of the invention allows for manual control of the gate 50 for various reasons. For example, there may be a number of easily accessible devices in which manual control can be conducted without significant effort. Accordingly, the actuator of the invention is adapted to receive a manual hand crank or other hand implement used to selectively rotate the gate in the desired position. As mentioned, one example for manual control may include use of a ratchet gear in which a hand crank manipulates the ratchet gear to the desired setting. The gate in this example is manually controlled by turning the crank by hand to position the gate in the desired angular orientation. Indexing of desired or pre-set gate positions may be accomplished manually by sight referenced markers placed on the panel guides 54 and indexed with a point located on the actuator such as a point placed on a gear or on mechanical linkage used to rotate the gate. As mentioned, incremental control of the position of the gate may be assisted by use of dampening devices, such as a torsion spring or an oil dampener in which the gate is prevented from relatively free rotation without overcoming the spring or dampening force. A dampening device may also be used to control the speed at which the gate is allowed to raise or lower, which provides a design feature for the gate to match incremental and changing settling pond conditions so that water is preferably only slowly released at the very top of the water column until the gate reaches a new operator set position.

Also associated with semi-automatic control of a water control device are one or more manual controls that may be incorporated on the controller. For example, two dials can be provided to manually set parameters such as the desired water depth of the water column and a timer which sets the estimated drawdown time in which the change in water depth is to occur. For example, if it is desired to drop the water level by 6 inches, an operator would adjust the water depth from its existing height (as visually perceptible by a water depth gauge installed adjacent the device) and subtracting 6 inches from the current water depth. The operator would then set the timer for how long the drawdown should take place. Based upon the size of the impoundment area and the flow rate capability of the device, an operator could adjust the dial for the desired drawdown time. A quick reference guide could be provided on the device with a table indicating maximum drawdown rates for the particular impoundment area.

Automatic control by use of a controller may be achieved in which very small incremental positions of the gate can be set and changed. Inputs to the controller may include limit switches or optical sensors that detect positioning of the gate. Based on these inputs, output control signals can be generated to adjust the positioning of the gate. Other inputs to the controller may include level switch indicators that detect the level of the water column and which may trigger a programmed response to reposition the gate. For example during a rain event, it may be desirable to raise the level of the gate to prevent excessive overflow of water through the riser.

In connection with automatic control, the invention further includes user options to program operation of the riser, and to independently set or override a programmed aspect of the control. The controller includes software or firmware enabling the programmable aspect of the system. Various user interfaces are provided to enable the user to select and control system operation. For example, with respect to the slow fall option associated with a slow and controlled lowering or falling of the gate, the program can instruct signals to the motor to gradually but slowly lower the gate until the set position is achieved. It is also contemplated that there can be automatic control provided directly at the field location where the riser is installed with simplified commands. For example, an input module may be connected directly to the motor with a limited number of control buttons to manipulate positioning of the gate. Examples of such simplified control could be an input module with separate buttons to "Raise", Lower", "Slowly Raise" or "Slowly Lower" the gate.

Another programmable option for the automated riser of the invention is to utilize a programmable and removable chip associated with an onboard controller of the motor. More specifically, a very simple and economical controller may be provided with the motor in which a programmable chip may be programmed and reprogrammed as necessary. One particular software protocol that may be used in conjunction with programming of a controller of the system may be use of Supervisory Control and Data Acquisition type software (SCADA software). This software example is one which is specifically designed to be incorporated within a system that controls a number of remote and distinct types of field devices, such as wells, irrigation valves, etc.

The invention further includes data acquisition and retention regarding history of operation for the automated riser of the invention. Such data may include gate index positions, gate position history, gate position history as a function of environmental conditions, etc. The data may also include the rate of water flowing through the riser device or the volume of water that has passed through the riser device. The water volume and water flow rate data may be received from a flow meter positioned within the device or the use of pressure sensors. This data can be used to further refine system programming and to improve system predictability and performance.

Other aspects of operation and programmable control of the system include monitoring inputs. As mentioned, inputs to the controller may include various switches, sensors, timers, and the like. Specific examples of monitored conditions may include the current gate position, a history of gate position changes over a specified period of time, a battery charge status, and alarm or alert status history. In connection with an alarm or alert status, various conditions may trigger an alarm or alert such as an out of range water level condition with respect to the column of water being controlled by the riser, failed gate setting changes, a low battery condition, a freeze alert in which the body of water is frozen and may therefore prevent proper drainage, and various types of mechanical failures sensed by system inputs. Additional examples of monitored conditions may include a rainfall history, such as measured by an electronic rain gauge that communicates with the system, a soil moisture condition as measured by a soil moisture probe that communicates with the system, current weather and historical weather conditions obtained from various weather information services, still photo data as captured by one or more cameras which communicate with the system, and various water level sensors integrated within the system. It should be understood that this is not an exclusive and exhaustive listing of potential monitored inputs to the system, and that others may also be considered as other factors may affect optimal operation and performance of the riser device.

Other aspects of control include system inputs that enable control of one or multiple water control devices in the system. With respect to these inputs, they are used to monitor on site field conditions so that real-time information can be viewed at any time by an operator via a smart phone, computer, or other connected device. The processor of the controller is equipped with the necessary communication components enabling both wireless and cellular control of the system. Accordingly, the controller includes a cell data modem, a radiofrequency card, and various relays to provide communication, automation, and programming. One or more cameras, a water level sensor or switch, a gate/weir position sensor or switch, an inclinometer, and a thermometer provide on-site information. Voltage and amperage is also monitored in the system to determine the status of the system. For example, monitoring the amperage draw by the drive motor or motor controller can indicate whether the water control device is able to successfully rotate in response to incremental commands, or to indicate perhaps a problem with binding or obstruction which prevents the gate or rotating weir from smoothly rotating. Similarly, a low voltage condition may indicate a low battery and required maintenance, or perhaps a problem with power production from the solar panels. A thermometer may also be another input to the controller in which low temperature can indicate ice conditions. Further, a timer associated with the controller is able to associate measured data with specific dates and times.

With these control capabilities, an operator does not have to be physically present to handle operation of any particular water control device which provides great efficiencies in manpower and transportation requirements. Many routine water management decisions can be made in advance and scheduled or can be accomplished through automation to alter gate and rotating weir positions as certain field conditions occur.

Another aspect of the invention which may be accomplished by automated control is the ability to set the water control gate and rotating weir slightly lower than the water level for continuous draining such that only the very top of the water column is allowed to drain. Complete emptying of the impoundment area can therefore be achieved in which a minimum amount of sedimentation and pollutants are allowed to travel downstream. Regulatory requirements with respect to agricultural runoff often mandate that water released downstream is of a specified quality, and the water control device of the present invention is ideal for selectively controlling exact volumes of water to be released downstream to release only water that is of the requisite quality. In connection with regulatory requirements, algorithms can be developed that provide reliable modeling in terms of water release such that there is minimum sedimentation and pollutants allowed to travel downstream. For example, data can be generated from test flows in which sedimentation and pollutants are measured as a function of the top down depth of the water column that is allowed to be released downstream. In other words, sedimentation and pollutants can be measured as a function of how much water is allowed to travel through the device over time, and volumetric calculations can then be equated to water qualities associated with various test releases. From this empirical data, algorithms can be developed to optimize water release for each impoundment area. Sedimentation profiles can be developed for each impoundment area; that is, these profiles can provide data as to the amount of sedimentation and pollutants in a water column by incremental water column measurements relating to the status of the impoundment area. These statuses may include whether the impoundment area has been relatively still allowing settling, or whether the impoundment area has been quickly filled due to a rain event which will cause increased turbidity. Sedimentation profiles based on these statuses can then determine the precise water gate height for optimal drainage of the selected impoundment area. In addition to sedimentation profiles based on testing, the invention may further include water quality sensors, rain sensors, and a barometric pressure gauge as inputs to the controller to precisely manage the drawdown of an impoundment area. For the water quality sensors, these may include sensors which measure nitrogen, dissolved oxygen, phosphorus, turbidity, etc. Measured levels of these parameters can be used within various algorithms to determine the optimal drawdown rate for the impounded area. For example, high nitrogen levels or phosphorus levels may indicate that the impoundment area has been quickly filled, and these undesirable elements are found at unacceptably high levels within the water column, necessitating an increased settling time. Similarly, if there are high turbidity levels, this may indicate poor water quality at the top of the water column indicating additional time should be set for drawdown to allow for needed settling. With respect to a rain gauge, a barometric pressure gauge, as well as a temperature gauge, each of these parameters may also provide an indication as to water quality at incremental levels in the water column.

In summary, with the addition of telemetry in which an operator is able to view and record a wide range of factors which may affect water quality, the operator is able to make better decisions as to how to manage release of water from the impounded area. Further, this data can be shared with other professionals such as wildlife biologists, agronomists, and others and water management can be conducted remotely. Further, the water management data provided by the system can provide cover mental agencies with data which may improve water quality, preserve the alluvial aquifer corresponding to the impoundment areas, and other information they need to quantify the environmental and economic benefits that could be obtained by controlled water release.

One particular example of an application for the present invention includes agricultural fields which retain various levels of water during an annual agricultural cycle. The system and method of the invention simplifies irrigation management while providing significant improvement to downstream water quality. Further, the invention can introduce new and valuable irrigation practices to tile and furrow irrigation systems as well as zero grade flood irrigation. The invention saves water and the energy required to pump water, improves crop yields by improved water management, and moves irrigation management away from more costly and unpredictable manual management.

Another example of an application for the present invention includes construction areas where there is disturbed soil. It is well-known that many construction areas have rainfall which collects in low lying areas disturbed by construction efforts. Topsoil retention and contaminant containment present significant management and regulatory challenges for the construction industry. While on-site settling ponds are commonplace, most are built without any control structures and the result is that once the settling ponds are full, they remain full which reduces their ability to absorb and several contaminants from the next rain event. The water control device of the invention installed within a settling pond automatically reduces pool volume without simultaneously dumping silt and contaminant loads downstream. Accordingly, the settling pond is able to better absorb the next rain event and settle out additional sediments and contaminants that may collect in the settling pond.

Yet another application of the system and method of the invention may include wildlife management areas. Controlling impoundment areas may greatly improve soil management for native grasses. By controlling when and at what rate water is applied to these native grasses, and then removed, increased growth of certain seed bearing grasses may result and these grasses may be desirable to waterfowl. Another specific application for wildlife management could include green tree reservoirs. It is well-known that waterfowl are attracted to flooded green timber areas. However, leaving standing water on living timber too long or at the wrong time can kill the trees. A water control device of the invention installed in a green tree reservoir is an ideal solution for managing water such that it may attract waterfowl, but may then drain the impoundment area at the appropriate times to prevent timber kill. Yet another specific application for wildlife management could include wetland reserve conservation areas. The growing of grain crops for waterfowl on conservation land is mostly prohibited according to environmental regulations. Moist soil management techniques are proven successful promoting seed and crustacean development for waterfowl use, but these techniques are time and labor intensive and also are typically beyond the capabilities of a typical landowner. Installation of a water control device of the present invention adds automatic expertise to controlling moist soil management, thus improving results while alleviating a landowner from potentially expensive and burdensome manual efforts to control water levels. The water control device also provides an opportunity for professionals such as biologists or agronomists to directly participate in a user's management practices remotely.

According to yet another aspect of automation and control, waterfowl management can also be accomplished according to the system and method of the invention. In the case of the system in which there are multiple impoundment areas, the cameras associated with each water control device can also be used to observe waterfowl. This information can then be immediately conveyed to government wildlife personnel, hunters, or others who may wish to obtain a real-time understanding of the location of waterfowl and the impoundment areas in which they are found. It may also be desirable to modify the characteristics of selected impoundment areas order to enhance waterfowl management. For example, it may be desirable to expand the size of an impoundment area to attract more waterfowl for purposes of authorized hunting. Accordingly, the water level in the impoundment area can be increased over time by raising the target gate levels. Similarly, if it is desired to discourage waterfowl from a particular impoundment area, then that area could be selectively drained to a level which would induce the waterfowl to move to another location. The visual data coupled with the ability to selectively increase or decrease the size of any number of impoundment areas provides many benefits for waterfowl management.

Figure 13:
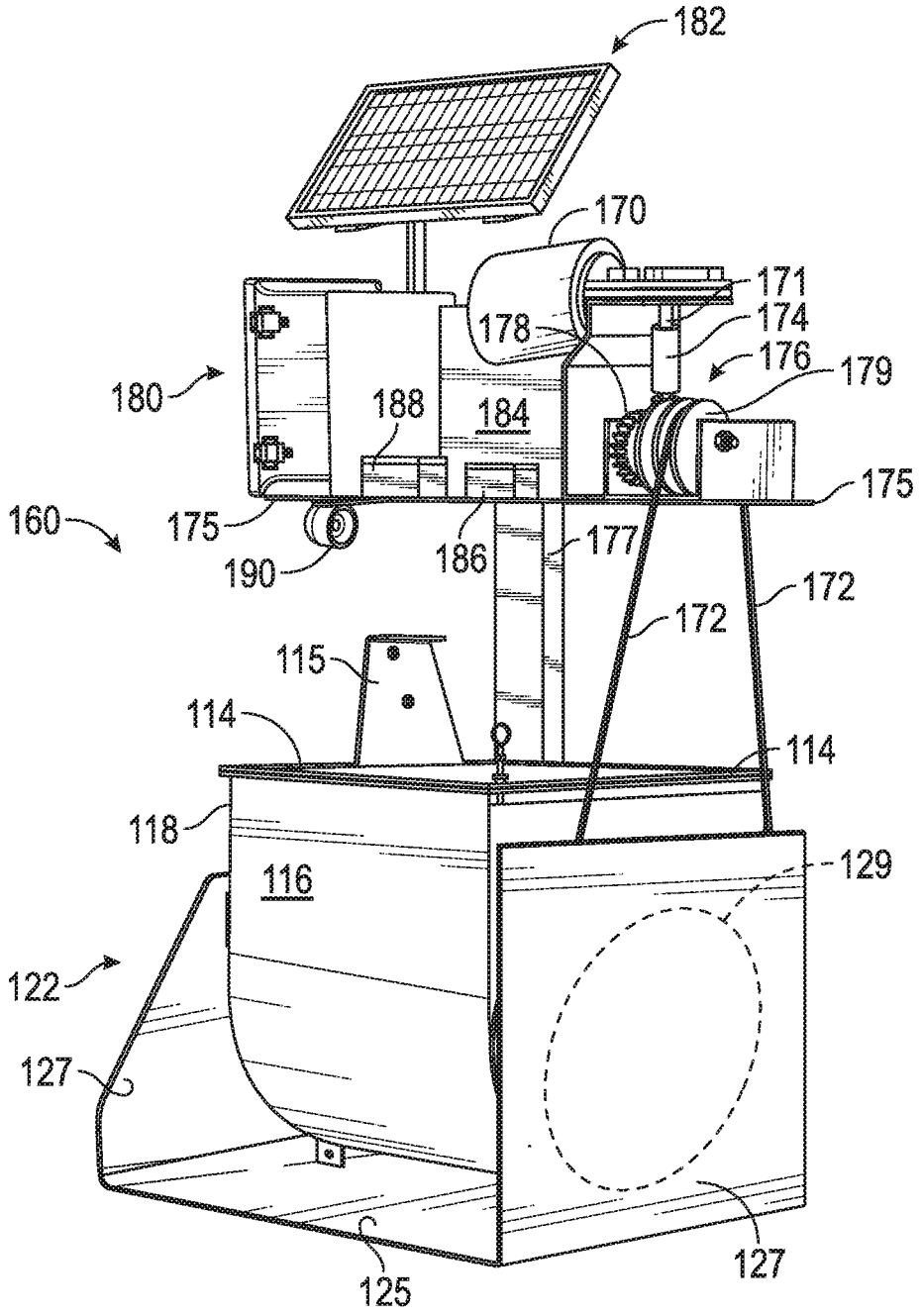
FIG. 13 illustrates a perspective view of another preferred embodiment of the invention.
Figure 14:
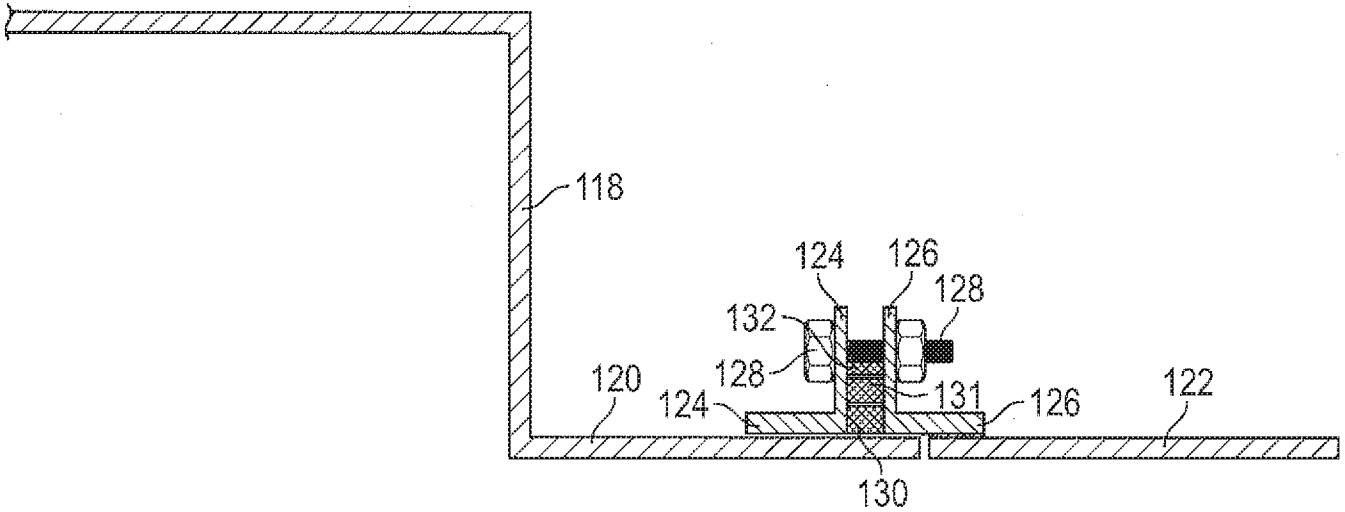
FIG. 14 illustrates a partial schematic cross-sectional view of the embodiment of FIG. 13 detailing a flange connection between an extension of the housing and a drain.
Figure 15:
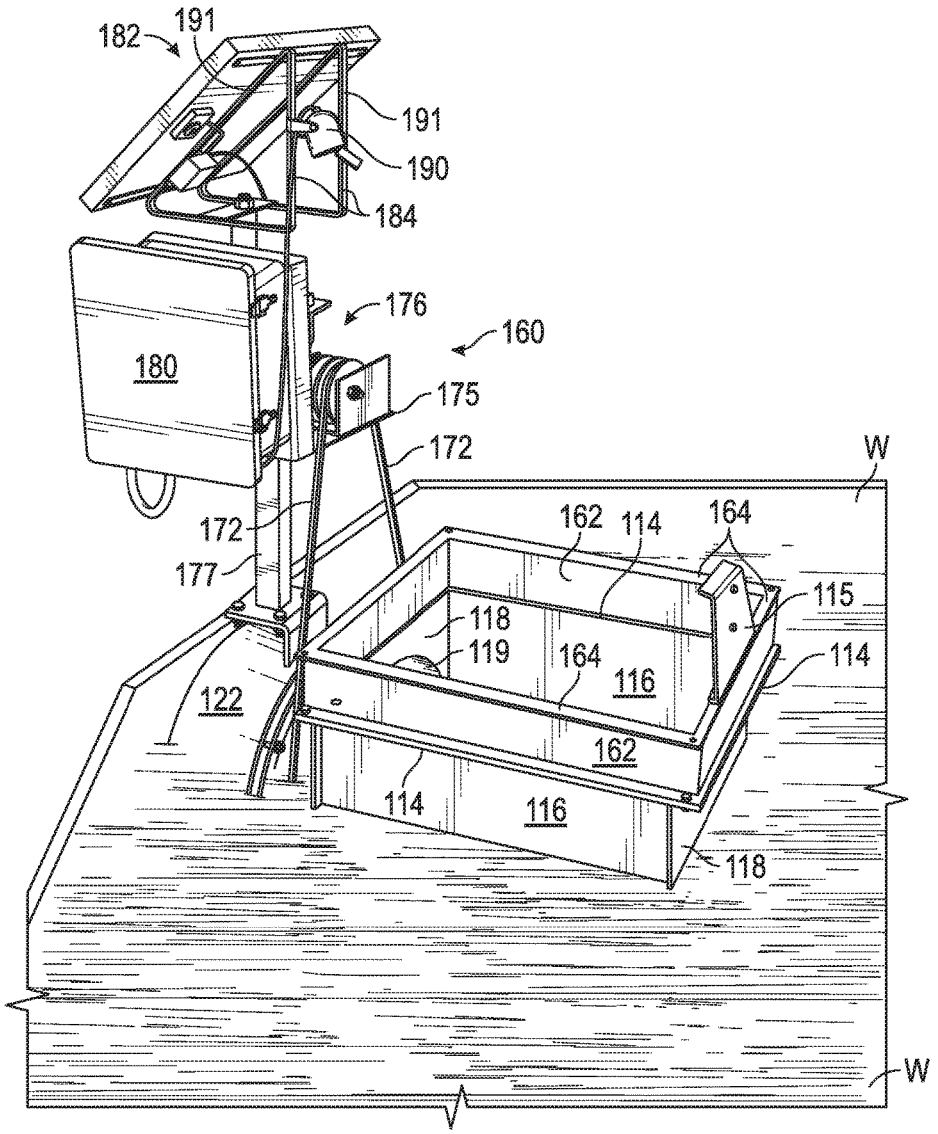
FIG. 15 illustrates a perspective view of the embodiment of FIG. 13 showing the invention installed in an impounded body of water.

FIGS. 13-18 illustrate additional embodiments of the invention characterized by a water control device having a rotatable housing to control water levels. Referring first to FIGS. 13-15 these illustrate a water control device 160 incorporating automatic control. The device 160 includes the rotatable housing 112 with opposing sidewalls 116 and opposing end of walls 118 forming an enclosure. One side, shown as the upper side is open to allow water to flow over the weir edges 114 when the water level is above the weir edges 114. When the water level of the impounded area is to be selectively lowered, one upper edge of the weir edges 114 remains above the level of the water while the opposing weir edge 114 of the housing is below the water level thereby allowing water to spill over the lowered weir edge. It is contemplated that the rotatable housing 112 may be rotated in either direction thereby selectively raising or lowering either of the weir edges. The positioning of one of the weir edges is monitored by an electronic inclinometer 117 (FIG. 16) mounted to an inclinometer bracket 115. As the housing rotates, the inclinometer 117 provides input signals to the controller in which very slight rotational changes can be detected. These rotational changes correspond to a known incremental height of the weir edge 114 to which the inclinometer bracket is mounted. When it is desired to set the weir edge at a desired height, the housing is rotated to a desired angular orientation and the inclinometer 117 provides electronic signals to confirm the weir edge is at the desired height. Electronic inclinometers are very accurate instruments that can measure very slight changes in angular orientations.

FIGS. 13 and 16-18 also show a mounting base 123 that allows the device to be securely mounted to the bed of the impoundment area. As shown, the mounting base 123 includes a mounting plate 125 that rests against the bed and two upstanding mounting brackets 127. One of the brackets 127 secures one end wall 118 of the housing in which a support post or shaft 121 extends from the end wall and is secured within a bearing assembly 131. The other mounting bracket 127 is attached to the drain member 122. An opening 129 is cut in the bracket 127 to facilitate the particular sized drain member 122 used in the installation. The mounting plate 125 may be anchored to the bed of the body of the water as may be necessary for stability. Anchoring could be achieved, for example, by ground anchors (not shown) secured to the mounting plate. Further structural details of the embodiment shown in FIG. 13 show the device 110 including a lateral housing extension 120 that extends laterally away from one of the end walls 118 to which it is connected. A corresponding drain opening 119 (see FIG. 15) formed in the end wall and communicating with the lateral housing extension 120 allows for downstream flow of water through the device and through the connected drain member 122 that is connected to the lateral housing extension 120 on the upstream side and connected to the bracket 127 on the downstream side.

Referring also to the partial cross sectional schematic of FIG. 14, the lateral housing extension 120 is placed within a first circumferential connection flange 124 that faces a second circumferential connection flange 126 welded to the drain member 122. Three elements are placed between the opposing facing surfaces of the flanges 124 and 126 as shown, namely, a circumferential guide rail 130, a circumferential compression packing seal 131, and a circumferential compression band 132. The guide rail 130 is used to provide additional surface area across the gap between the flanges for contact with the lateral housing extension. This guide rail 130 therefore helps to stabilize the lateral housing extension across the gap so the lateral housing extension can more reliably rotate without binding. Disposed above the guide rail 130 in this figure is the compression packing seal 131 which provides a waterproof seal. The seal 131 is sufficiently compressed between the facing surfaces of the flanges to achieve the seal. Disposed above the seal 131 in this figure is the compression band 132 which constrains the outer peripheral side of the seal 131 to prevent it from expanding. The lateral housing extension 120 is not welded to the first connection flange 124, accordingly, the lateral housing extension and housing are able to freely rotate in which a sealed connection is maintained across the lateral housing extension and the drain member. The drain element 122 and all downstream connections to the drain element remain stationary. To clarify the lateral housing extension 120 is not physically connected to the flange 124, a slight gap is shown in this figure as compared to the area in contact between the second flange 126 and the drain element 122 that is connected as by welding with no gap shown. A plurality of nut and bolt sets 128 are spaced circumferentially around the respective flanges to maintain the desired offset between the flanges and the nuts are tightened to provide a waterproof seal by sufficient force being placed against the compression packing seal 131 by the facing surfaces of the flanges.

FIGS. 13 and 15 further illustrate automatic control for positioning of the rotatable housing by a drive motor 170 which drives a cable or chain 172. The motor 170 has an output shaft 171 that drives a socket 174 which in turn drives a hex nut of a gear reduction cable drive 176. Rotation of the hex nut by the socket 174 results in rotation of the roller(s) of the cable drive 176 to facilitate smooth displacement of the cable 172. The cable drive 176 is more specifically shown as comprising one or more gears 178 and one or more rollers 179 secured to the table top 175 by a support bracket. A controller (not shown) provides control signals to the drive motor to selectively rotate the output shaft 171 an incremental amount that corresponds to a desired user setting for a gate height. More specifically, selected and incremental rotation of the output shaft causes incremental rotation of the roller(s) of the cable drive, which in turn causes incremental displacement of the drive cable 172 causing the selected weir edge to lower or rise. As mentioned with respect to FIG. 14, while the housing 12 and housing extension 120 rotate, the other parts of the water control device remain stationary.

Other elements shown in this embodiment include the solar panel 182 to provide system power and a control box 180 which may house the controller (not shown), RF communication equipment (not shown), a control panel (examples shown in FIGS. 19 and 20), and other control elements that may be associated with the device. The energy produced by the solar panel 182 is stored in a battery 184 and the battery powers the drive motor. In addition to the inclinometer 117, the device may further include a water level sensor 186 that provides an indication of the water level in the impoundment. A corresponding water level probe (not shown) extends into the body of water and is mounted adjacent the mounting post 177. The probe communicates with the water level sensor and the sensor provides inputs to the controller for monitoring the water level. One or more circuit breakers 188 and other electrical control elements may be added for controlling voltage and amperage for all electrical system components.

A system video camera 190 may also be added to visual monitoring of the device and the surrounding body of water. The camera may provide helpful diagnostic information as to the operational status of the device; for example, if the housing becomes clogged with debris as water flows into the housing.

FIG. 15 shows a modification to the embodiment of FIG. 13, namely, an upper housing skirt 162 that may be attached to the upper surface 114 of the housing to provide an increased depth range for which the device can control a water column in an impoundment. As shown, the housing skirt 162 provides an incremental vertical length or height to the sidewalls 116 and end walls 118. Accordingly, the weir edge in this embodiment is defined as the upper surface of the housing skirt, shown as extended weir edge 164. FIG. 15 also illustrates the device installed in an impounded body of water W in which the level of the water is below the extended weir edge 164. Water control is achieved by selectively rotating the housing 112 to a desired water column height measured from the bottom surface of the body of water W. As mentioned, the housing may be rotated either direction thereby raising one edge 164 or lowering an opposing edge 164. If the water height is below or at a desired level, the housing is rotated such that the weir edges remain above the upper surface of the water.

Figure 16:
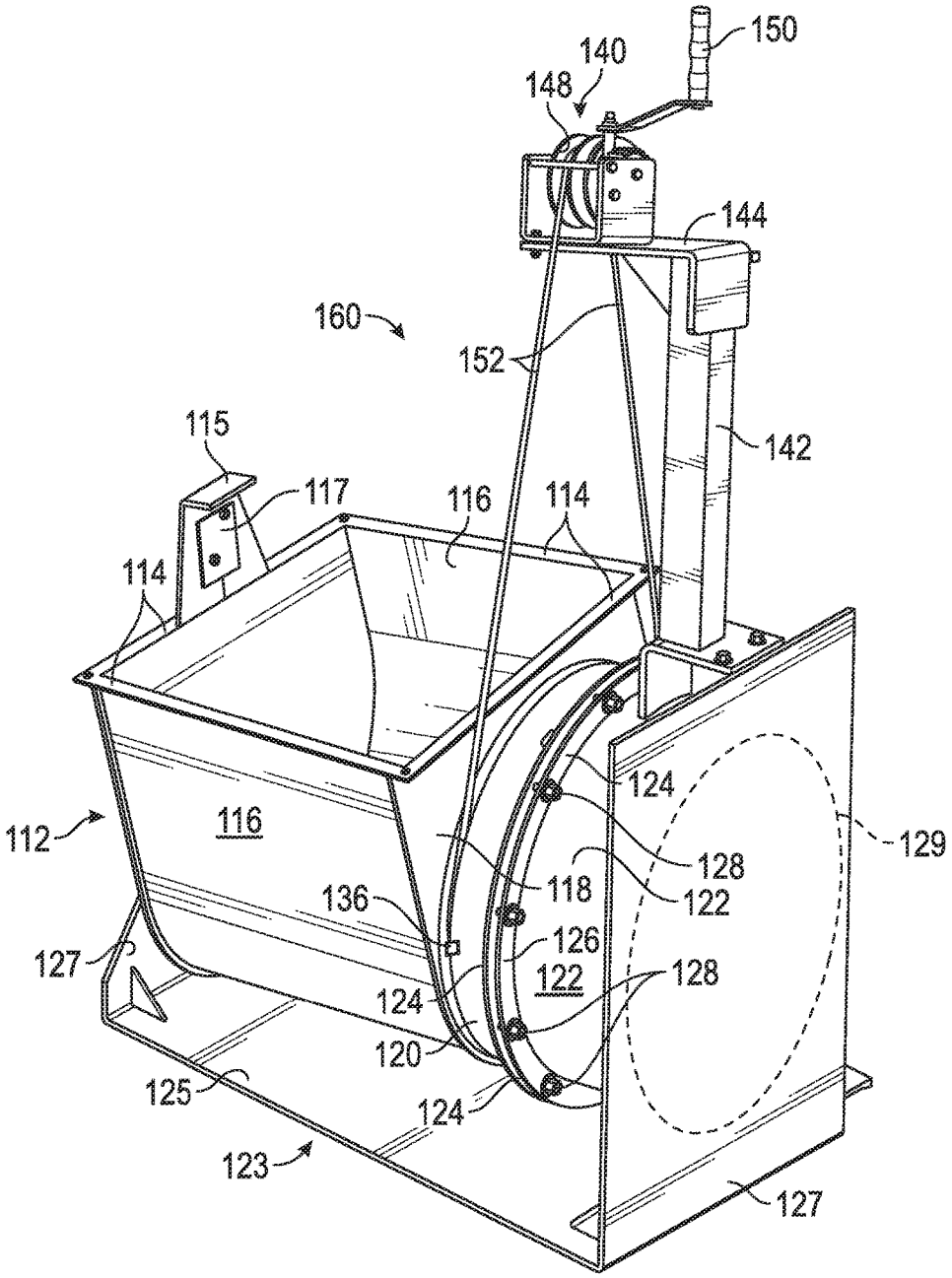
FIG. 16 illustrates a perspective view of another embodiment of the invention.

The embodiment of FIG. 16 shows another embodiment that incorporates manual control in which the rotatable positioning of the housing 112 is achieved by an actuator 140 in the form of a hand crank assembly. More specifically, a mounting post 142 and bracket 144 serve to elevate a hand crank 150 that may be operated to rotate the hand crank thereby causing corresponding rotation of a spool 148 connected to the hand crank by a gear configuration (not shown) positioned between the crank and spool. A cable 152 interconnects the spool 148 to the lateral housing extension 120. A cable mounting eye 136 attached to the housing extension 120 receives the cable 152.

According to another aspect of the invention, the actuator 140 may be the gear reduction cable drive 176 in which the drive motor and socket are disconnected and the hand crank has a box wrench end that attaches directly to the hex nut of the cable drive. There are variations to this manual embodiment in which the crank handle can be used if the drive motor is inoperable, or if it is desired to provide only manual control in which the drive motor and all other automatic control elements are eliminated. In summary, the automatic controlled embodiments of FIGS. 13 and 15 can be easily converted to a manually controlled embodiment by simply disconnecting the drive motor 171 and associated linkage, and using the hand crank that is directly attached to the hex nut of the gear reduction cable drive.

The user can selectively actuate the crank handle to cause rotation of the housing in which a selected number of rotations or partial rotations is known to lower on weir edge 114 a known incremental measurement. For example, if it were desired to lower one of the weir edges 114 two inches to thereby lower the water in the impoundment, this two inch change in water depth could correspond to a known number of rotations or partial rotations of the hand crank depending upon how the actuator was geared. This correspondence between a change in the weir height and the number of hand crank turns could be set forth in a table made available to the user.

Figure 17:
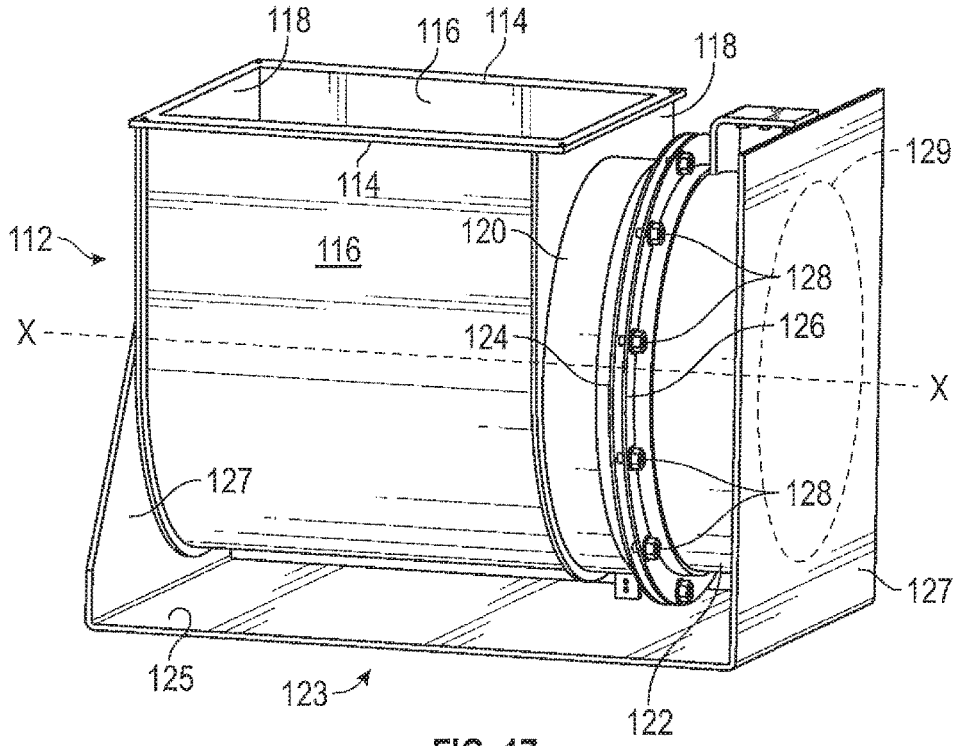
FIGS. 17 and 18 are additional perspective views of the housing of the embodiments of FIGS. 13 and 15 to further show structural details of the housing.
Figure 18:
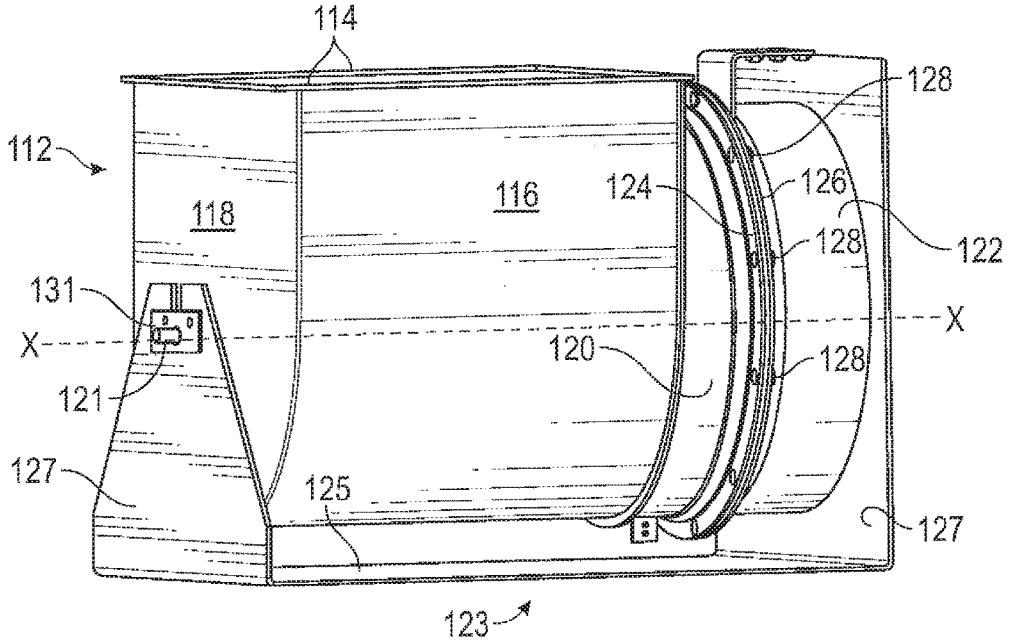

FIGS. 17 and 18 illustrate additional views of the rotatable housing 112, the lateral housing extension 120, and the drain element 122. As shown, the sidewalls 116 and end walls 118 form a substantially rectangular shaped enclosure with an open upper end. The lower end of the housing is rounded or curved. The housing rotates substantially horizontal about a horizontally disposed axis X-X. A rotational hinge point 119 allows the housing 112 to rotate about the axis. Although the housing is shown in this embodiment having a specified shape, it shall be understood that the specific shape of the housing can be modified to accommodate a desired flow of water through the device. For example, the upper edges of the housing could form a different shape, such as something other than rectangular; e.g., oval, curved, rounded, or triangular. Accordingly, the sidewalls and end walls could be formed to accommodate the different shape.

Figure 19:
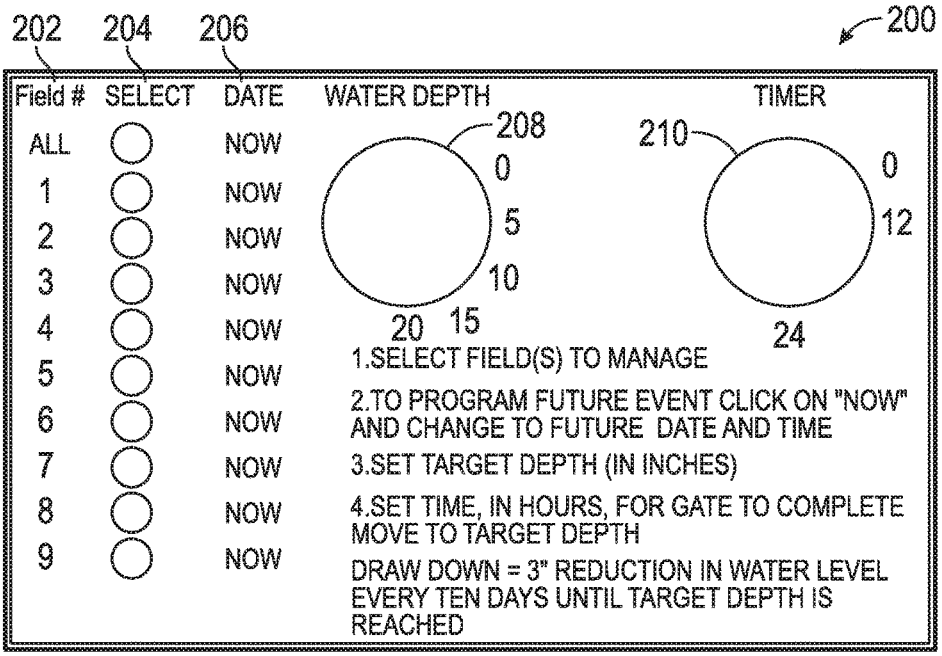
FIG. 19 is a schematic diagram of a control panel that may be used in connection with any of the embodiments of the invention.

Referring to FIG. 19 a control panel 200 is illustrated that may be incorporated on the water control device in order to provide on station or on site control. This on site control can be used in conjunction with remote operation of the devices, as explained in detail below with respect to the remote control functionality of the invention explained with respect to the user interfaces of FIGS. 22-31. The control panel 200 may be housed within the control box 180 and may be securely mounted therein. Alternatively, the control panel may have a Bluetooth interface with the controller which enables a user to operate the controller a short distances from the device. The control panel shows a sealed or location selector 202, a select button 204, an action date 206, a water depth selector 208, and a timer 210. Directions may be provided on the control panel as shown. A user first selects the impoundment areas to manage, in this case, referenced as Fields. The user may select one, some or all of the Fields. In the case of multiple fields, this control panel made be a centralized control in which wired or wireless communications are used to operate a water control device located at each one of the field locations. To program a future event, the user selects the "Now" option in the action date 206 for the selected fields/locations. The user then moves the water depth selector dial 208 to set the desired water depth. The user then moves the timer dial 210 to set the time for the gate (weir edge) to reach the selected water depth. In the case of water in an impoundment that is not settled, that is, the water has recently risen in the impoundment area due to excessive rain, then because of the amount of sediment suspended in the water, it is desirable to select a slower draw down for the gate to move to the target depth. This slower movement of the gate limits the amount of water passing through the device and can be specifically set to allow only a very top portion of the water column to pass through the device which settles first. Accordingly, this allows more time for settling of pollutants and sedimentation. The controller may display the drawdown rate, and in the example of FIG. 19, the drawdown rate is 3 inches per ten day period until the target depth is reached. This calculated drawdown rate can be based upon pre-existing calculations or estimates as to how much water is able to flow through the water control device over a period of time.

Figure 20:
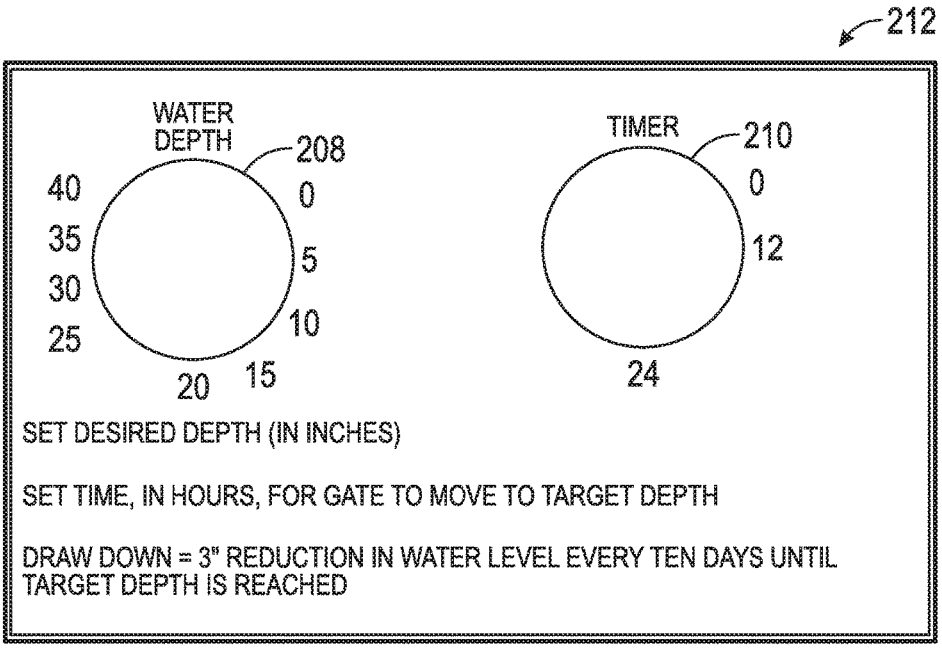
FIG. 20 is a schematic diagram of another control panel that may be used in connection with any of the embodiments of the invention.

FIG. 20 illustrates another example control panel 212, the same reference numbers in this figure corresponding to the same functions in the example control panel of FIG. 19.

Figure 21:
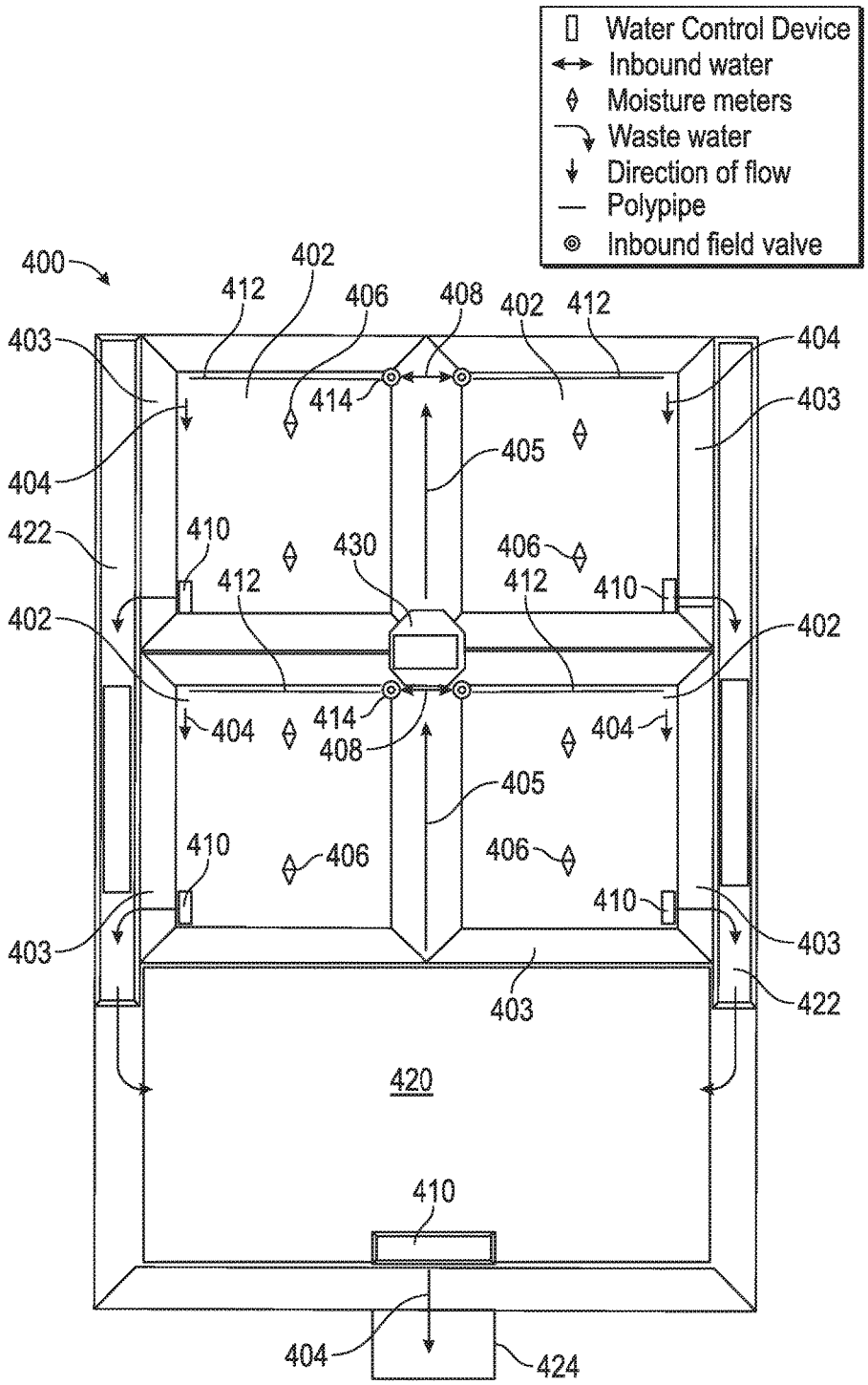
FIG. 21 is a schematic plan view of a water control system in connection with another embodiment of the present invention.

FIG. 21 illustrates another embodiment in the form of a system of the invention in which multiple fields or impoundment areas are controlled by corresponding water control devices, and irrigation equipment is included within the system to show sources of irrigation water that affect the impoundment areas. FIG. 21 more specifically shows another embodiment of the invention in which an irrigated agricultural plot 400 incorporates a number of water control devices thereby facilitating a control system of the invention that provides for integrated water control for many impounded water areas. In this figure, four impounded water areas 402 are shown, and these areas may correspond to selected agricultural fields that are used for growing crops or used strictly for water impoundment, or combinations thereof. Each of the impounded areas 402 are shown as bounded by some type of barrier 403 which could include earthen berms or other types of raised soil, rock, or man-made features. The lateral sides of the plot 400 may include ditches 422 that allow water to flow in the downstream direction to a tail water recovery area 420.

Within each of the impounded water areas 402, a water control device 410 is installed that allows independent control of water height in each of the areas 402. Other elements making up the irrigated plot 400 include a plurality of moisture meters 406 which can measure the moisture content of the soil, and a plurality of irrigation valves 414 that provide incoming water to the corresponding impounded area. Schematically shown in this diagram is also a well 430 that provides water to a network of irrigation pipes 412, such as poly pipe irrigation members. The directional flow of water is indicated generally by arrows 404 in which the plot is graded such that water will flow in a downstream direction consistent among the impoundment areas; however, it is also contemplated that one or more of the impoundment areas may have their own specific grades causing the water to flow in a different direction. The water control devices 410 are installed at the downstream end of the impounded areas. Incoming water from the field valves 414 are schematically shown as double arrows 408, it being understood that the incoming water can be selectively applied to any particular section of the impounded areas 402.

As excess water may develop over time in any one of the impounded areas, the corresponding water control devices 410 are operated to allow the excess water to flow downstream through the ditches 422 into the tail water recovery area 420. The tail water recovery area 420 also serves as a secondary water source to return water to selected ones of the impounded areas in the event the impounded areas require further irrigation. For example, there is also a water control device 410 installed at the downstream side or edge of the tail water recovery area 420. This water control device can be operated to allow water to travel downstream into a pump 424, and the pump may move the water back upstream as indicated by directional arrows 405 to provide further irrigation water. Since the device 410 installed in the tail water recovery area only allows the water to pass through the device from the top of the water column, as previously mentioned, this top portion of the water column has fewer contaminants and sediment; therefore, this water can be used as return irrigation water.

Figure 22:
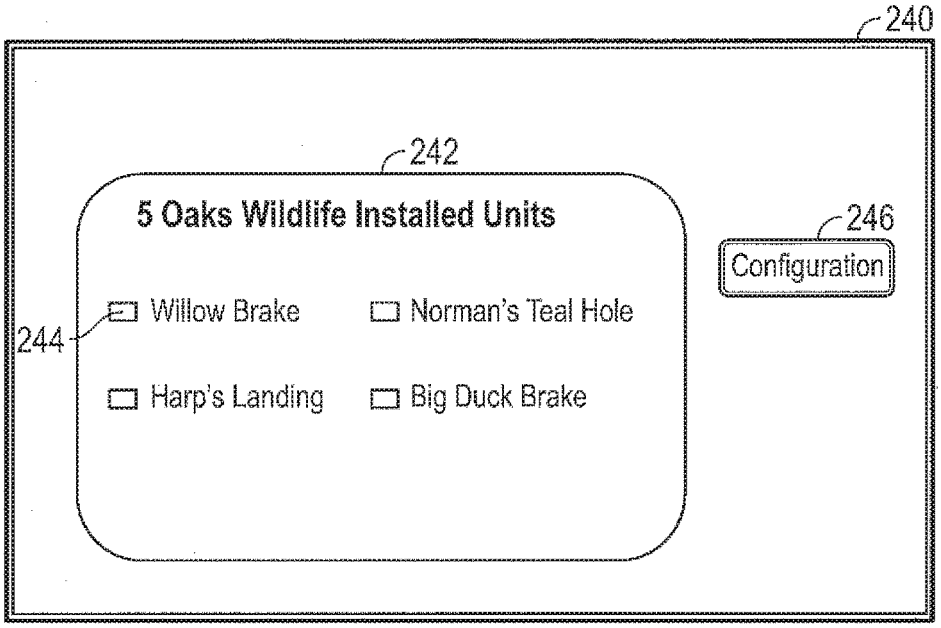
FIG. 22 is a schematic diagram of a sample user interface associated with automatic control of an embodiment of the invention.

FIG. 22 illustrates a user interface 240 associated with automatic control of the devices and system of the invention. This user interface, along with the other user interfaces described herein, are intended to represent example functionality as to how a user may remotely control operation of water control devices employed by themselves or within a plurality of devices making up a water control system. These user interfaces are intended to generally represent any type of user interface that can be viewed on the screen of a mobile device, a screen associated with a computer, or any other user interface which has an input device capability. Accordingly, these user interfaces could represent touch screen displays where the user selects functions by touch on the user interface, or the user could use a conventional cursor or pointer in order to select functions available on the user interface.

The example user interface 240 is a location selection screen in which a plurality of installed units 242 may be controlled, and the user may select one or more of the locations 244 to be configured. For example, the user may wish to select the Willow Brake location, and then option 246 to set up or configure the water control device at that location.

Figure 23:
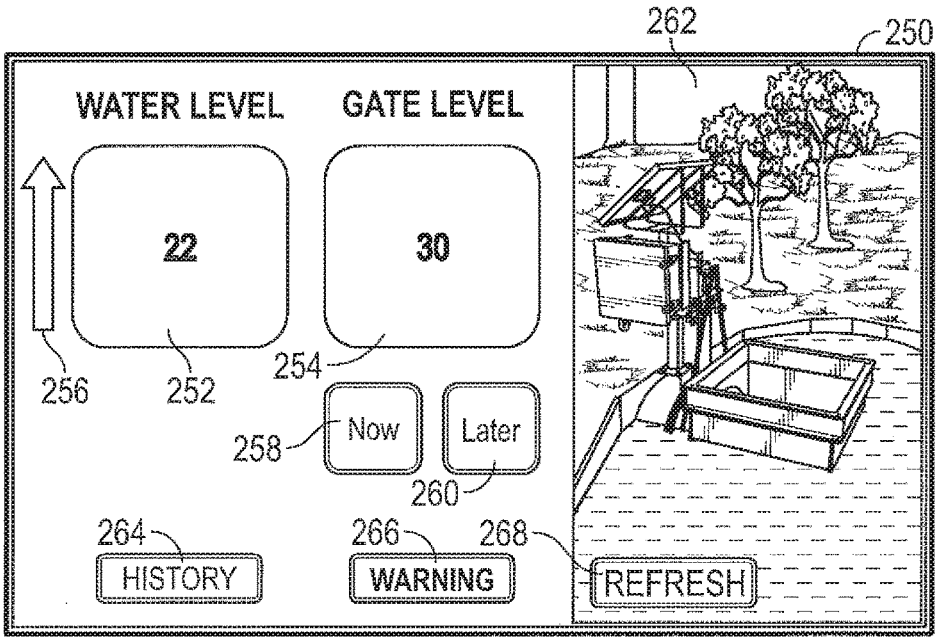
FIG. 23 is a schematic diagram of another sample user interface associated with automatically sending a gate level.

FIG. 23 shows another example user interface 250 in which the user has selected a location for configuration. In this screen, the user is able to observe the current water level in the corresponding impoundment area 252, shown as 22 inches. Water trend indicator 256 provides an indication of whether the water level is rising or lowering and in the example, the arrow points up indicating the water is currently rising. The user is also able to view the current gate level or gate position 254, shown as a gate level of 30 inches. Two further options are provided, namely, a Now indicator 258 which if selected, shows the currently selected gate level. The Later indicator 260, if selected, will show the gate level that has been set for a future time. A history button 264 allows the user to choose this option to display another screen illustrating the recent history of the water level in the selected impoundment area, as discussed further below. A warning indicator 266 is provided to warn or otherwise communicate to the user that there could be an alarm or warning condition at the impoundment area. The user may, for example, select the warning indicator 266 if activated to view another screen would be made visible to the user to view the exact warning or alarm condition. The system may also be equipped with a remote camera which provides visual confirmation of the status of the water control device. For example, an RF camera could be set up a selected distance from the water control device to provide a view which shows the control device within the impoundment area. This camera as shown on this user interface provides a photograph or video 262 of the area. A refresh button 268 allows the user to activate the camera to take the present photograph or video of the observed area. Accordingly, the camera can be programmed to provide intermittent video or photographs over selected periods of time.

Figure 24:
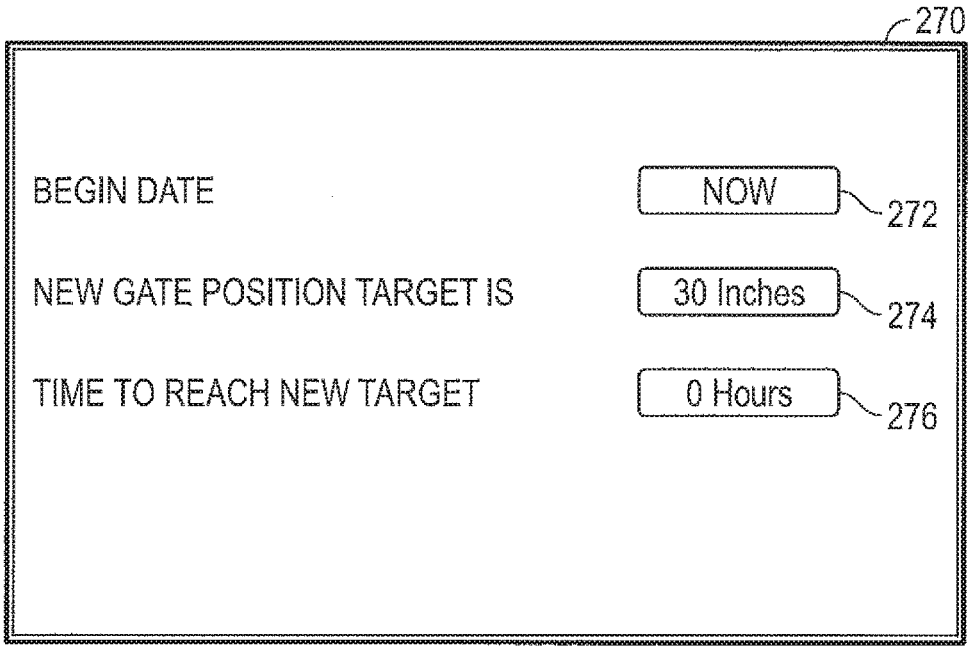
FIG. 24 is a schematic diagram of another sample user interface associated with selecting a time, gate position, and time to reach the targeted gate position.

FIG. 24 illustrates another user interface 270, such as one that can be used to select a present or future gate position as well as the time for the gate to move to the target depth. This interface can be selected, for example, by choosing either the Now button 258 or Later button 260 on the user interface 250 of FIG. 23. In the example of this FIG. 24, the begin date 272 is now. The new gate position target 274 is 30 inches, and the time to reach the new target 276 is now, i.e., 0 hours.

Figure 25:
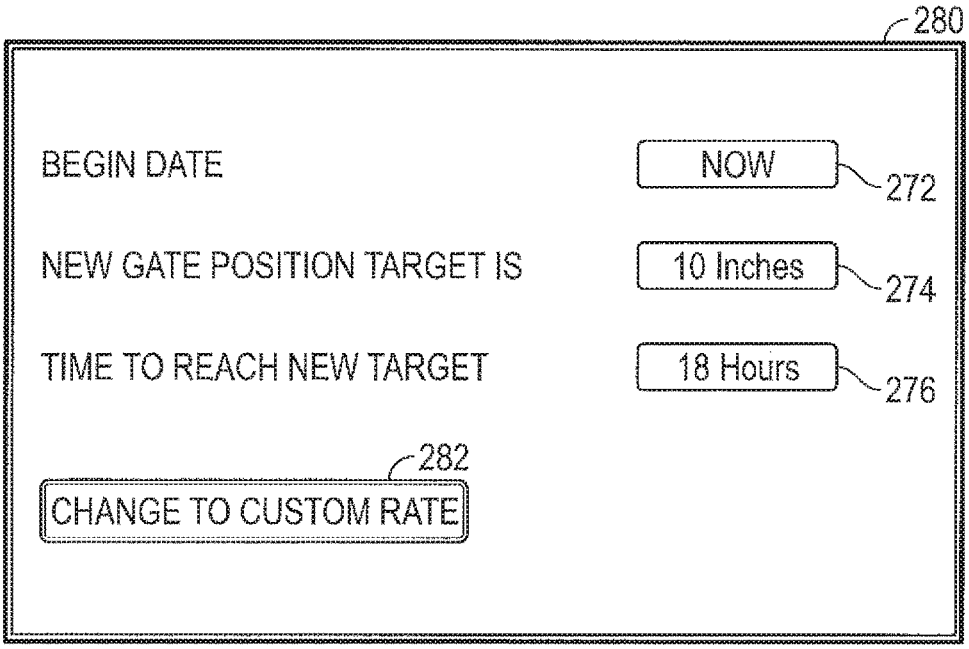
FIG. 25 is a schematic diagram similar to FIG. 24 illustrating an option for selectively changing a predetermined rate to which the new gate position is obtained.

Referring to the further example shown in FIG. 25, the begin date 272 is now. The new gate position target 274 is 10 inches, and the time to reach the new target 276 is 18 hours. FIG. 25 shows an additional user interface 280 similar to FIG. 24; a begin date 272, a new gate position target 274, a time to reach a new target 276, and an additional function that allows the user to change the rate at which the target time is reached. This function is shown as Change to Custom Rate selector 282 which enables a user to change the rate at which the new gate position target is reached, that is, the time to which the position of the gate level is changed to reach the target water level.

Figure 26:
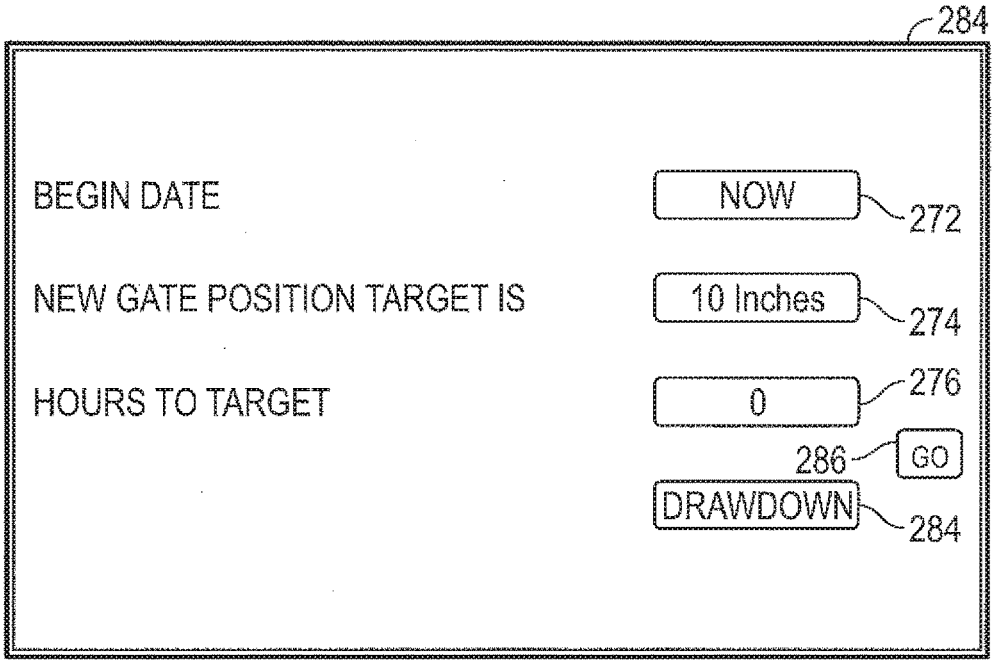
FIG. 26 is a schematic diagram similar to FIG. 24 illustrating additional functionality associated with setting a gate level or position and a selected type of pre-established drawdown protocol.

FIG. 26 shows yet another user interface 284 allowing a user to set the begin date 272, the gate position target 274, and the time to reach the target 276. This figure also shows a drawdown indicator 284 that will illuminate or otherwise show an active status when a drawdown is occurring. The go button 286 is selected to commence execution of the draw down.

Figure 27:
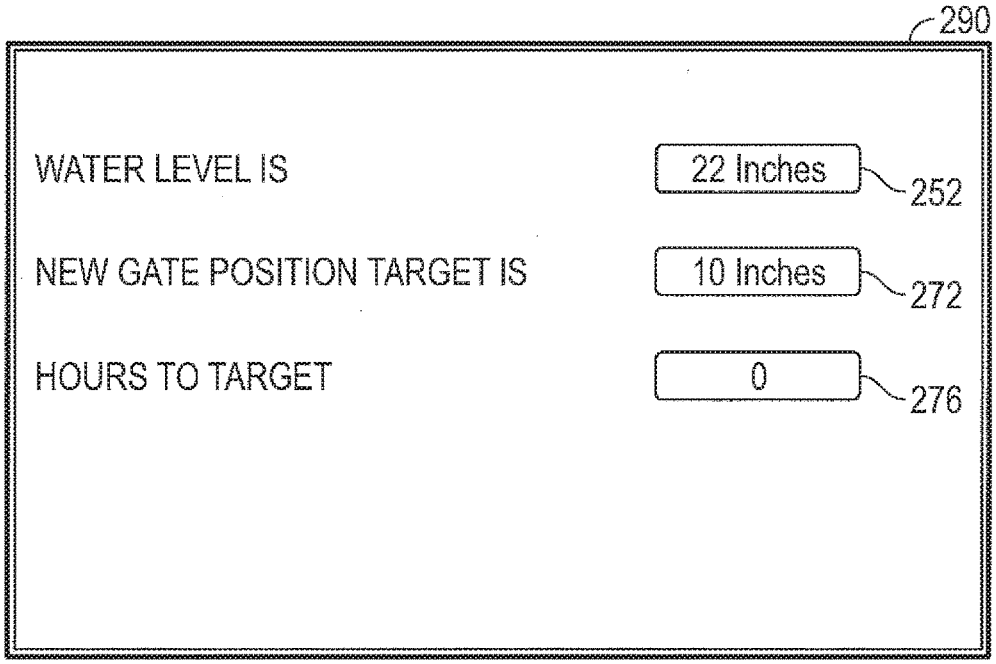
FIG. 27 is another schematic diagram that provides information to the user including the current water level height, the new gate position target, and the time to reach the target in which the gate or weir is moved so the water level reaches the target.

FIG. 27 shows another user interface 290 with information available to a user similar to the other user interfaces; a water level 252, a new gate position target 272, and a time to reach the target 276.

Figure 28:
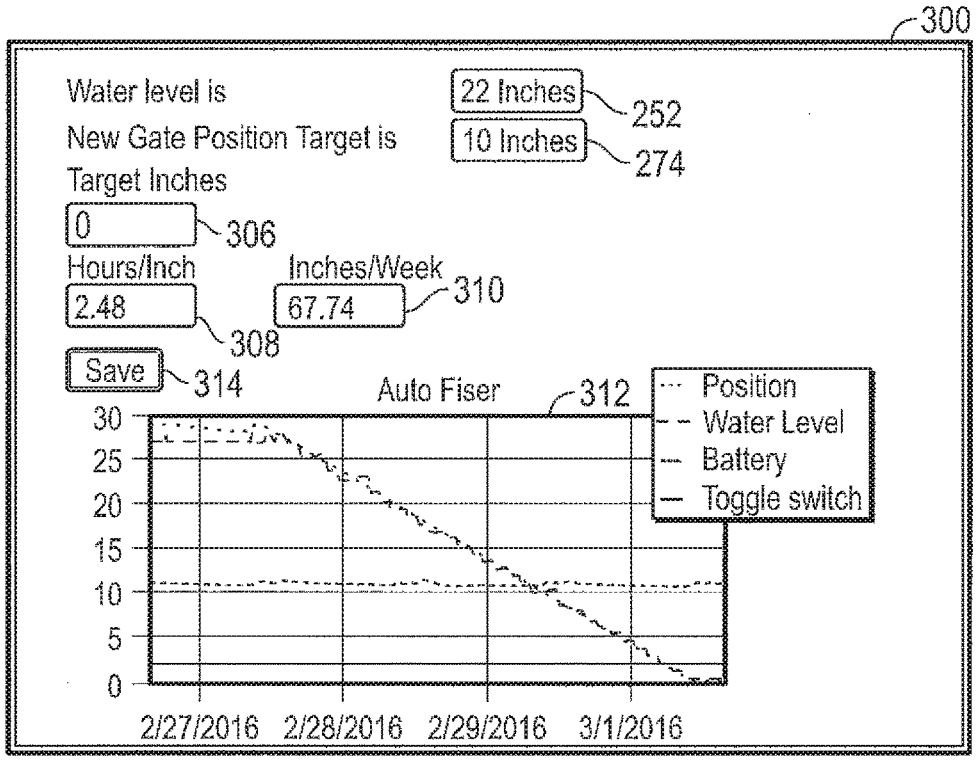
FIG. 28 is another schematic diagram illustrating a user interface that displays information regarding a gate position target along with a graphical display showing a change in water level over time.

FIG. 28 shows another user interface 300 with additional information that can be provided to the user or management. Specifically, this user interface shows the water level 252, the new gate position target 274, the target inches 306—that is, the change in water level by inches from the current water level to reach the target; the estimated hours per inch 308—that is, the rate change of the water level in hours per inch; the estimated inches per week 310—that is, the rate change of the water level in inches per week; and a graph 312 showing the change in water level and the change in position of the gate position over a selected period of time. Save button 314 allows the user to save or otherwise record the specific data presently shown, and that may be selected for output such as a report format. All of this data provided to the user provides greater management tools in historical data as well as predicting future events.

Figure 29:
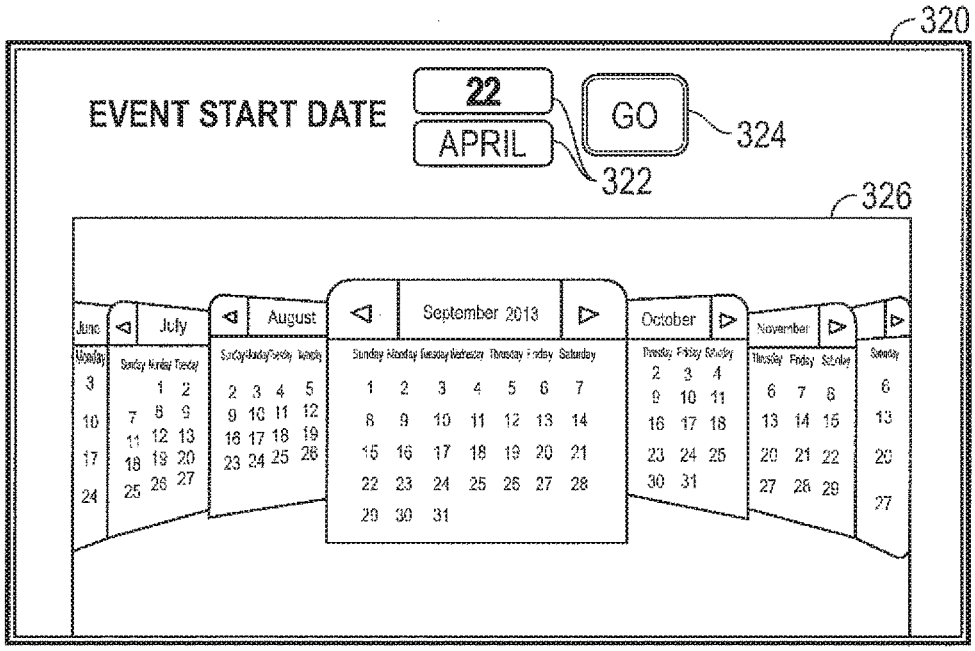
FIG. 29 is another schematic diagram illustrating a user interface that allows a user to select a particular date for an event to commence.

FIG. 29 shows another user interface 320 which allows a user to select a particular date to execute an action. In the example of FIG. 29, this user interface allows the user to, such as adjusting the gate position. Specifically, the interface shows a date and month 322 they can be selected from a visual calendar selector 326. Once the desired event date has been determined, the go button 324 can be selected.

Figure 30:
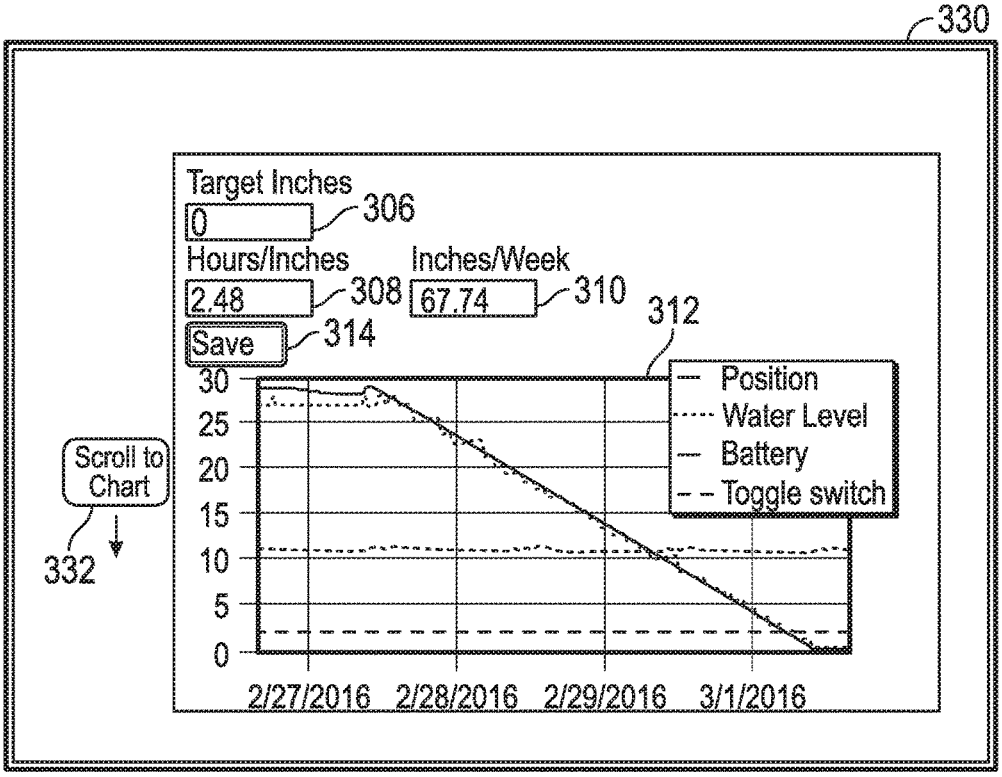
FIG. 30 is another schematic diagram illustrating a user interface that allows a user to view and select changes in water level by measured increments such as inches, and further showing a graphical display illustrating a change in water level over time.

FIG. 30 shows yet another user interface 330, similar to FIG. 28, with detailed information that allows a user to manage a particular selected impoundment area. As shown, this user interface provides the same information as FIG. 28, along with a scroll selector 332 allows the user to access a detailed chart showing additional recording information about a selected water control device and impoundment area.

FIG. 31 shows yet another user interface 340 with a detailed chart 342 containing information regarding one or more water control devices. The information is data that has been recorded by each device and made accessible via a remote access, such as the Internet or a wireless connection. The processor of the invention has a memory and one or more associated databases for selective storage of data. This data can be used to generate a number of control functions as well as use for historical data for determining water flow trends or characteristics within a known impoundment area. Specifically, FIG. 31 shows the following recorded data: (1) The Unit ID corresponds to the individual water control devices installed at various locations; (2) The Date Stamp indicates the date upon which the data was obtained; (3) The Time Stamp indicates the time when the data was recorded; (4) The Water Level indicates the height of the water column at the device; (5) The Gate Position indicates the set height of the gate or weir at that time; (6) The Gate Target is the gate or weir height to be obtained at some pre-set future time; (7) The Hours to Target is the time when the gate or weir will reach the Gate Target as measure from the present time recorded. In the example of FIG. 1, the first two devices have Hours to Target time of 6.15 hours from the respective Time Stamps; (7) The Voltage is the measured operating voltage of the device. In the event of a low voltage condition such as may be caused by a drained battery, an inoperable solar panel, or other reasons, a voltage alarm may be generated in a user display; (8) The Amps is the measured amperage draw on the actuator which may be the control motor. In the event of an out of limit amperage draw, such as a high amperage draw caused by a clogged housing or gate which prevents the motor from turning its drive shaft, an amperage alarm may also be generated in another user display; (9) The Temp is the measured temperature at the corresponding device; and (10) The Rain is the measure rainfall in a given period, the example provided in the figure being rainfall within the prior 24 hour period.

Figure 32:
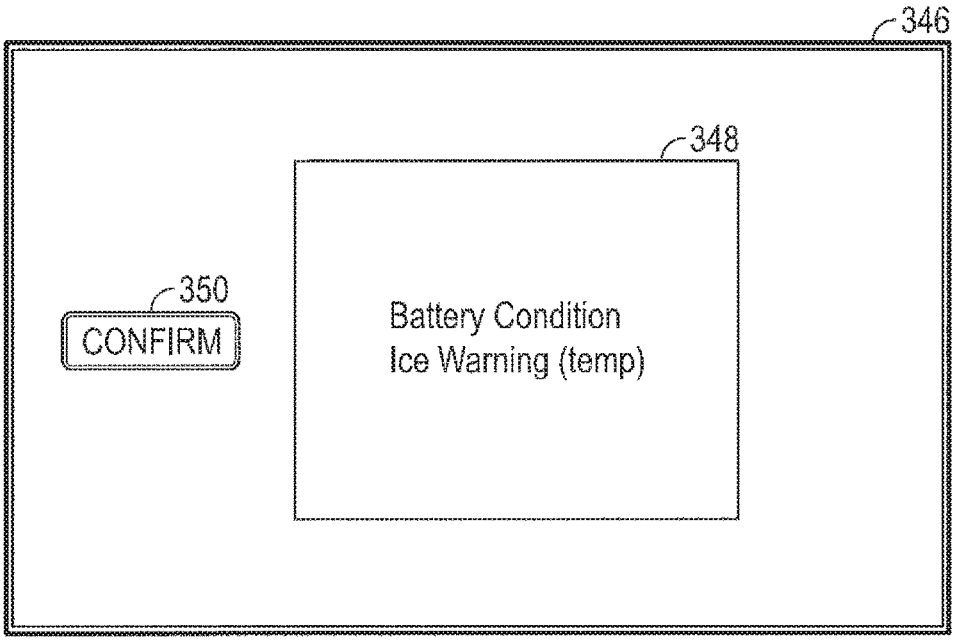
FIG. 32 is a sample user interface showing an alarm condition enabling a user to take an appropriate corrective action.

FIG. 32 is yet another user interface 346 with information regarding an alarm or warning condition. The example in this figure shows two potential alarm conditions 348, namely, a low battery condition and an ice warning. For example, for the battery condition, if the battery of a particular water control device was in a critical low voltage situation, the battery condition indicator could flash or otherwise provide a visual warning to the user. Similarly, if the location at which the water control device was installed had low temperatures at or near freezing, the ice warning indicator could flash or otherwise warn the user that it is possible ice could be forming at the device which may prevent normal flow of water through the device. The confirm button 350 allows the user to confirm that the alarm situation has been handled, or to otherwise signify that a remedial action needs to take place or has already taken place. Therefore, it should be understood that FIG. 32 represents the ability of a water control device to generate warning signals regarding status of the device which can be viewed by a user at a remote location.

From the foregoing, it is apparent that a system, method, and various embodiments of water control devices are provided in which automation and advanced programming allows for accurate, precise, and timely control of water impoundment areas. Accordingly, the invention allows for control of the release of water from seasonal or temporary impoundment such as agricultural fields, settlement basins which may have at least seasonal water, more permanent bodies of water such as ponds or lakes, as well as waterfowl management areas. The invention may be operated as a stand alone device, or as a component within a network of water management devices. The economic and environmental benefits obtained provide an advance solution as compared to prior flashboard riser devices.

Although the invention is disclosed herein in one or more preferred embodiments, it shall be understood that various changes and modifications can be made to the invention commensurate with the scope of the claims appended hereto.

What is claimed is:

1. A water control device for control of water from an impounded water source, comprising:

a rotatable housing including sidewalls and end walls forming an enclosure to receive water from the water source, said rotatable housing having an open upper end defined by at least one weir edge;

a housing extension extending away from one of said end walls and an opening formed in said end wall and through said housing extension;

a drain connected to said rotatable housing extension for transporting water away from said enclosure;

an actuator communicating with said rotatable housing to selectively and controllably rotate said housing thereby raising and lowering said at least one weir edge;

a controller for automatically controlling the rotation of the rotatable housing to selectively raise or lower the at least one weir edge to a selected height, and user interfaces associated with said controller providing user options to program and select features relating to system control; and wherein said rotatable housing is rotatable about an axis by said actuator so that said at least one weir edge defines a gate height over which water flows when a water level is above said gate height, said water being captured in said enclosure and subsequently flowing through said drain.

2. The water control device, as claimed in claim 1, wherein:

said housing extension includes a first connection flange and said drain includes a second abutting connection flange;

a flexible seal disposed between said connection flanges; and wherein said rotatable housing and said housing extension are rotated in sealing engagement with said drain that remains stationary.

3. The water control device, as claimed in claim 2, wherein:

said flexible seal includes a circumferential guide rail, a circumferential packing seal disposed radially outward from and in contact on a first side thereof with said guide rail, and a compression band disposed radially outward from and in contact on an opposite second side of said compression seal.

4. The water control device as claimed in claim 1, wherein:

said housing extension extends substantially horizontally from said rotatable housing and said axis extends substantially horizontal.

5. The water control device, as claimed in claim 1, wherein:

said actuator comprises a (i) cable attached to said housing or said housing extension; (ii) a spool to wind and unwind said cable; and (iii) a motor to rotate the spool to selectively and incrementally retract or extend the cable.

6. The water control device, as claimed in claim 1, wherein:

said actuator comprises (i) a chain attached to said housing or said housing extension; (ii) a sprocket; and (iii) a motor to rotate the chain or sprocket to selectively and incrementally rotate the rotatable housing.

7. The water control device, as claimed in claim 1, wherein:

said actuator comprises a (i) cable attached to said housing or said housing extension; (ii) a spool to wind and unwind said cable; and (iii) a hand crank to rotate the spool to selectively and incrementally retract or extend the cable.

8. The water control device, as claimed in claim 1, wherein:

said user interfaces provide functionality to execute operation and control of said rotatable housing in response to inputs to said controller.

9. The water control device, as claimed in claim 1, further including:

an integral power source for providing power to selectively rotate said rotatable housing.

10. The water control device, as claimed in claim 9, wherein:

said power source includes a battery and solar panels for charging said battery.

11. The water control device, as claimed in claim 1, further including:

at least one camera mounted to said water control device to provide video or photographical information regarding the operation and status of the water control device.

12. The water control device, as claimed in claim 11, further including:

a plurality of additional cameras remotely communicating with said controller to provide additional video or photographical information regarding the status of the impounded body of water around said device.

13. The water control device, as claimed in claim 1, further including:

a plurality of inputs to said controller for management of the operation of the water control device, said inputs including at least one of (i) a water level sensor for determining a level of the water around the device, (ii) a position sensor to determine a position of the at least one weir edge, and (iii) a thermometer for measuring temperature at said device.

14. The water control device, as claimed in claim 1, wherein:

one of said user interfaces includes a user interface control page for selecting a gate level wherein the gate level automatically changes to match the selected gate level on the user interface.

15. The water control device, as claimed in claim 14 wherein:

said control page further shows a current water level and an indication of whether the water level is rising or lowering.

16. The water control device, as claimed in claim 14 wherein:

said control page has a selectable option for executing a gate level change at a desired time.

17. The water control device, as claimed in claim 14 wherein:

said control page further includes a selectable option for when to begin the gate level change, a selectable option for an amount of time to reach a targeted drawdown, a selectable option for a standard drawdown rate, and a selectable option for commencing the drawdown.

18. The water control device, as claimed in claim 1, wherein:

one of said user interfaces includes a user interface with a selectable option for setting a gate level and a graphical display showing an estimated a drawdown rate of a height of the water in the impounded area over time.

19. The water control device, as claimed in claim 1, wherein:

one of said user interfaces includes a user interface with selectable options for setting a future date for which to execute a task, said task including adjusting a gate level.

20. The water control device, as claimed in claim 1, wherein:

one of said user interfaces includes a user interface that displays historical data as selected by user, said data including a historical record of at least one of: gate positions of said device, water levels, rainfall, temperature, battery voltage and battery amperage.

21. The water control device, as claimed in claim 1, wherein:

one of said user interfaces includes a user interface that displays warning conditions associated with said water control device, said warning conditions include at least one of: a low battery condition, an amperage overload condition, an ice warning, a flood, warning, and an inclination change indicating the water control device is no longer at a pre-established inclination.

22. A water control system to control flow of water from an impounded water source, said system comprising:

(a) a rotatable housing including sidewalls and end walls forming an enclosure to receive water, said rotatable housing having an open upper end defined by at least one weir edge; a housing extension extending away from one of said end walls and an opening formed in said one of said end walls and through said housing extension; a drain connected to said housing extension for transporting water away from said enclosure; an actuator communicating with said rotatable housing to selectively and controllably rotate said housing thereby raising and lowering said at least one weir edge; wherein said rotatable housing is rotatable about an axis by said actuator so that said at least one weir edge defines a gate height over which water flows when a water level is above said gate height, said water being captured in said enclosure and subsequently flowing through said drain; and (b) a controller communicating with said actuator to control operation of said rotatable housing, said controller being programmed to execute selected commands to control a height of said at least one weir edge.

23. The system, as claimed in claim 22, further including:

an integral power source for powering said controller and said actuator.

24. The system, as claimed in claim 23, wherein:

said power source includes a battery and solar panels for charging said battery.

25. The system, as claimed in claim 22, wherein:

said actuator includes a motor and mechanical means communicating with said rotatable housing to selectively and controllably raise and lower said at least one weir edge.

26. The system, as claimed in claim 25, wherein:

said mechanical means comprises at least one of gears, cables, and chains.

27. The system, as claimed in claim 22, further including:

user interfaces associated with said controller providing a user options to program and select features relating to system control.

28. The system, as claimed in claim 27, wherein:

said user interfaces provide functionality to execute operation and control of said gate height in response to inputs to said controller.

29. The system, as claimed in claim 27, further including:

a user interface control page for selecting a gate level wherein the gate level automatically changes to match the selected gate level on the user interface control page.

30. The system, as claimed in claim 29 wherein:

said control page further shows a current water level and an indication of whether the water level is rising or lowering.

31. The system, as claimed in claim 29 wherein:

said control page has a selectable option for executing a gate level change at a desired time.

32. The system, as claimed in claim 29 wherein:

said control page further includes a selectable option for when to begin the gate level change, a selectable option for an amount of time to reach a targeted drawdown, a selectable option for a standard drawdown rate, and a selectable option for commencing the drawdown.

33. The system, as claimed in claim 27, wherein:

one of said user interfaces includes a user interface with a selectable option for setting a gate level and a graphical display showing the estimated a drawdown rate of a height of the water in the impounded area over time.

34. The system, as claimed in claim 27, wherein:

one of said user interfaces includes a user interface with selectable options for setting a future date for which to execute a task, said task including adjusting a gate level.

35. The system, as claimed in claim 27, wherein:

one of said user interfaces includes a user interface that displays historical data as selected by user, said data including a historical record of at least one of: gate positions of said device, water levels, rainfall, temperature, battery voltage and battery amperage.

36. The system, as claimed in claim 27, wherein:

one of said user interfaces includes a user interface that displays warning conditions associated with said water control system, said warning conditions include at least one of: a low battery condition, an amperage overload condition, an ice warning, a flood warning, and an inclination change indicating the water control device is no longer at a pre-established inclination.

37. The system, as claimed in claim 22, further including:

at least one camera mounted to said water control device and communicating with said controller to provide video or photographical information regarding operation and a status of the water control system.

38. The system, as claimed in claim 37, further including:

a plurality of additional cameras remotely communicating with said controller to provide additional video or photographical information regarding the status of the impounded body of water around said device.

39. The system, as claimed in claim 22, further including:

a plurality of inputs to said controller for management of the operation of the water control system, said inputs including at least one of (i) a water level sensor for determining a level of the water around the device, (ii) a position sensor to determine a position of e a weir edge, and (iii) a thermometer for measuring temperature at said device.

40. A method of controlling flow of water from an impounded water source, said method comprising:

providing a water control device including a rotatable housing including sidewalls and end walls forming an enclosure to receive water, said rotatable housing having an open upper end defined by at least one weir edge; a housing extension extending away from one of said end walls and an opening formed in said one end wall and through said housing extension; a drain connected to said housing extension for transporting water away from said enclosure; an actuator communicating with said rotatable housing to rotate said housing thereby raising and lowering said at least one weir edge; wherein said rotatable housing is rotatable about an axis by said actuator so that said at least one weir edge defines a gate height over which water flows, said water being captured in said enclosure and subsequently flowing through said drain;

providing a controller communicating with said rotatable housing to control rotation of said housing and a selected height for said at least one weir edge, said controller including at least one user interface enabling a user to select commands to be executed for operational control of said rotatable housing;

generating at least one input to said controller for detecting a status of said rotatable housing; and executing at least one output from said controller to complete a command for operational control of said rotatable housing, said at least one output resulting in manipulation of said actuator to selectively and controllably raise or lower said at least one weir edge.

41. A method of controlling flow of water from an impounded water source to achieve a selected drawdown protocol, said method comprising:

providing a water control device including a rotatable housing forming an enclosure to receive water, said rotatable housing having an open upper end defined by at least one weir edge;

a drain connected to a housing extension for transporting water away from said enclosure; an actuator communicating with said rotatable housing to rotate said housing thereby selectively raising and lowering said at least one weir edge; wherein said rotatable housing is rotatable so that said at least one weir edge defines a gate height over which water flows when a water level is above said gate height, said water being captured in said enclosure and subsequently flowing through said drain;

providing a controller communicating with said rotatable housing to control rotation of said housing and a selected height for said at least one weir edge, said controller including at least one user interface enabling a user to select commands to be executed for operational control of said rotatable housing;

selecting a drawdown protocol comprising computer instructions executable by said controller;

generating at least one input to said controller for detecting a status of said rotatable housing; and executing at least one output from said controller to complete a command for operational control of said rotatable housing, said at least one output resulting in manipulation of said actuator to selectively and controllably raise or lower said at least one weir edge commensurate with said drawdown protocol.

42. The method, as claimed in claim 41, wherein:

said selected drawdown protocol includes at least one of a continuous conservation drawdown, a calculated conservation drawdown, and a native grass moist soil drawdown.

* * * * *